US011241087B2

(12) United States Patent
Choi et al.

(10) Patent No.: US 11,241,087 B2
(45) Date of Patent: Feb. 8, 2022

(54) ADJUSTMENT MECHANISM AND STRUCTURE HAVING SAME

(71) Applicant: Inno-Sports Co., Ltd., Xiamen (CN)

(72) Inventors: Kwan Jun Choi, Xiamen (CN); Renhua Chen, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/003,047

(22) Filed: Aug. 26, 2020

(65) Prior Publication Data

US 2021/0059398 A1 Mar. 4, 2021

(30) Foreign Application Priority Data

Aug. 29, 2019 (CN) ..... 201921425550.2
Apr. 30, 2020 (CN) ..... 202020712844.X

(51) Int. Cl.
*A47B 9/14* (2006.01)
*A47B 3/091* (2006.01)
*A47B 3/08* (2006.01)

(52) U.S. Cl.
CPC ..... *A47B 9/14* (2013.01); *A47B 3/0913* (2013.01); *A47B 2003/0827* (2013.01)

(58) Field of Classification Search
CPC ..... A47B 9/14; A47B 3/0913; A47B 3/0818; A47B 2003/0827; A47B 2009/145; E05C 1/14; E05C 1/06; E05C 9/045; E05C 9/042; Y10T 16/451
USPC ..... 108/147.21
See application file for complete search history.

(56) References Cited

U.S. PATENT DOCUMENTS 2,752,987 A 7/1956 Smithers
2,875,007 A * 2/1959 Fox ..... A47B 9/14 248/188.5
3,027,209 A * 3/1962 Nielsen ..... A47B 91/02 108/146
3,276,815 A 10/1966 Cardy
3,410,232 A * 11/1968 Bills ..... A47B 3/0912 108/146

(Continued)

FOREIGN PATENT DOCUMENTS

FR 2807632 * 10/2001

OTHER PUBLICATIONS

Machine Translation of FR 2807632 (Year: 2001).*

*Primary Examiner* — Daniel J Troy
*Assistant Examiner* — Timothy M Ayres
(74) *Attorney, Agent, or Firm* — Morgan, Lewis & Bockius LLP

(57) ABSTRACT

Disclosed are adjustment mechanisms and structures including one or more adjustment mechanisms. An adjustment mechanism comprising a casing, first and second arms, a second arm, a button, and an elastic member. The first and second arms are movably disposed in a channel of the casing. The button is operably coupled with the first and second arms and selectively pushes a first end of the first arm out of a first side of the casing and a second end of a second arm out of a second side of the casing. The elastic member abuts the casing and button such that the button is held at a desired position and consequently the first and second arms are held at a desired state under normal conditions. The adjustment mechanisms of the present disclosure provide an easy, convenient and safe means for height or length adjustment.

20 Claims, 17 Drawing Sheets

(56) References Cited

U.S. PATENT DOCUMENTS

| | | | | | |
|---|---|---|---|---|---|
| 3,574,393 | A | | 4/1971 | Hughes | |
| 4,330,151 | A | | 5/1982 | Healey | |
| 4,974,871 | A | * | 12/1990 | Mao | B62B 3/02 16/113.1 |
| 5,414,895 | A | * | 5/1995 | Kazmark, Jr. | A45C 13/262 16/113.1 |
| 5,499,426 | A | * | 3/1996 | Hsieh | A45C 13/262 16/113.1 |
| 5,921,623 | A | | 7/1999 | Nye | |
| 6,047,442 | A | * | 4/2000 | Workman | A45C 13/262 16/113.1 |
| 6,186,590 | B1 | | 2/2001 | Tseng | |
| 6,247,203 | B1 | * | 6/2001 | Kuo | A45C 13/262 16/113.1 |
| 6,347,831 | B1 | | 2/2002 | Nye | |
| 6,572,203 | B1 | * | 6/2003 | Cheng | E05B 65/462 292/DIG. 18 |
| 6,644,734 | B1 | | 11/2003 | Tseng | |
| 6,843,183 | B2 | | 1/2005 | Strong | |
| 7,410,194 | B2 | * | 8/2008 | Chen | E05C 1/14 292/37 |
| 7,735,915 | B2 | | 6/2010 | Nye | |
| 8,474,098 | B1 | * | 7/2013 | Yang | A45C 13/262 16/113.1 |
| 9,738,295 | B1 | * | 8/2017 | Horowitz | A47B 3/0818 |
| 10,159,334 | B1 | | 12/2018 | Wang | |
| 10,206,496 | B1 | | 2/2019 | Miller | |
| 10,470,561 | B2 | | 11/2019 | Clegg et al. | |
| D895,345 | S | | 9/2020 | Leng | |
| 10,806,247 | B1 | | 10/2020 | Chen | |
| 10,806,248 | B1 | | 10/2020 | Chen | |
| 11,026,505 | B2 | | 6/2021 | Leng | |
| 2004/0070235 | A1 | | 4/2004 | Gregory | |
| 2004/0195869 | A1 | | 10/2004 | Zhurong | |
| 2004/0227382 | A1 | | 11/2004 | Lin | |
| 2006/0181114 | A1 | | 8/2006 | Nye | |
| 2008/0018142 | A1 | | 1/2008 | Yul | |
| 2012/0175919 | A1 | | 7/2012 | Kane | |
| 2021/0007474 | A1 | * | 1/2021 | Nye | A47B 3/0915 |
| 2021/0106132 | A1 | | 4/2021 | Chen | |
| 2021/0112967 | A1 | | 4/2021 | Leng | |
| 2021/0112968 | A1 | | 4/2021 | Ponomar | |
| 2021/0169214 | A1 | | 6/2021 | Choi | |
| 2021/0177135 | A1 | | 6/2021 | Leng | |
| 2021/0274930 | A1 | | 9/2021 | Choi | |

* cited by examiner

ADJUSTMENT MECHANISM AND STRUCTURE HAVING SAME

CROSS-REFERENCE TO RELATED APPLICATIONS

The present application claims priority to Chinese Utility Model Applications CN 201921425550.2 filed Aug. 29, 2019 and CN 202020712844.X filed Apr. 30, 2020. The disclosure of each application is incorporated herein for all purposes by reference in its entirety.

FIELD OF THE INVENTION

The present invention generally relates to adjustment mechanisms and structures having adjustment mechanisms and, in particular, relates to auto-locking adjustment mechanisms, adjustable assemblies having such adjustment mechanisms and tables having such adjustable assemblies.

BACKGROUND

Most existing foldable tables are not adjustable in height, and do not fully meet the needs of different people. Some existing tables are adjustable but with complex adjustment mechanisms, which may require more than one person for adjusting the height of the tables. In addition, some existing tables lack means to prevent unexpected folding or collapsing of a table, which may lead to hands caught by the table or other safety issues.

Given the current state of the art, there remains a need for adjustment mechanisms and structures such as adjustable assemblies and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides adjustment mechanisms and structures such as adjustable assemblies incorporating such mechanisms and tables that are easy, convenient and safe to use.

In various exemplary embodiments, the present disclosure provides an adjustment mechanism including a casing, a first arm, a second arm, a button, and one or more first elastic members. The casing includes a first side, a second side and a channel between the first and second sides. The first arm is disposed in the channel of the casing and includes a first end adjacent to the first side of the casing. The first arm is movable with respect to the casing along a first direction to selectively allow the first end of the first arm to protrude from the first side of the casing. The second arm is disposed in the channel of the casing and includes a second end adjacent to the second side of the casing. The second arm is movable with respect to the casing along the first direction to selectively allow the second end of the second arm to protrude from the second side of the casing. The button is operably coupled with the first and second arms and movable with respect to the casing along a second direction substantially perpendicular to the first direction such that movement of the button along the second direction causes movement of the first and second arms along the first direction. Each of the one or more first elastic members includes a first end abutting the casing and a second end abutting the button, thereby holding the button at a fixed position in the absence of any external force such that the first end of the first arm remains outside of the first side of the casing and the second end of the second arm remains outside of the second side of the casing.

In some exemplary embodiments, the first arm includes one or more first slots sloped with respect to the first and second directions. The second arm includes one or more second slots sloped with respect to the first and second directions. The button includes one or more first pins and one or more second pins. Each respective first pin in the one or more first pins is operably coupled with a corresponding first slot in the one or more first slots and movable along the corresponding first slot. Each respective second pin in the one or more second pins is operably coupled with a corresponding second slot in the one or more second slots and movable along the corresponding second slot. The one or more first pins and the one or more first slots collectively transfer the movement of the button along the second direction to the movement of the first arm along the first direction. The one or more second pins and the one or more second slots collectively transfer the movement of the button along the second direction to the movement of the second arm along the first direction.

In some exemplary embodiments, the button includes one or more cavities, each for accommodating at least a portion of a first elastic member in the one or more first elastic members.

In some exemplary embodiments, the first arm includes a third slot in the first direction, and the second arm includes a fourth slot in the first direction. The casing includes a third pin and a fourth pin. The third pin is operably coupled with the third slot and movable along the third slot to guide the movement of the first arm along the first direction. The fourth pin is operably coupled with the fourth slot and movable along the fourth slot to guide the movement of the second arm along the first direction.

In some exemplary embodiments, the adjustment mechanism further includes a second elastic member and a third elastic member. The second elastic member is disposed at the third slot of the first arm, and has a first end abutting the third pin and a second end abutting an end of the third slot that faces the first end of the first arm, thereby maintaining the first end of the first arm out of the first side of the casing in the absence of an external force. The third elastic member is disposed at the fourth slot of the second arm, and has a first end abutting the fourth pin and a second end abutting an end of the fourth slot that faces the second end of the second arm, thereby maintaining the second end of the second arm out of the second side of the casing in the absence of an external force.

In an exemplary embodiment, the first arm includes a first protection piece coupled or integrally formed with the third slot of the first arm to prevent disengagement of the second elastic member from the third slot of the first arm. The second arm includes a second protection piece coupled or integrally formed with the fourth slot of the second arm to prevent disengagement of the third elastic member from the fourth slot of the second arm.

In some exemplary embodiments, the button includes one or more fifth slots in the second direction, and the casing includes one or more fifth pins. Each respective fifth pin in the one or more fifth pins is operably coupled with a corresponding fifth slot in the one or more fifth slots and movable along the corresponding second slot to guide the movement of the button in the second direction.

In some exemplary embodiments, the first arm includes a first surface sloped with respect to the first and second directions. The second arm includes a second surface sloped with respect to the first and second directions. The button includes a third surface and a fourth surface sloped with respect to the first and second directions. The third surface is operably coupled with the first surface of the first arm, thereby transferring the movement of the button along the second direction to the movement of the first arm along the first direction. The fourth surface is operably coupled with the second surface of the second arm, thereby the movement of the button along the second direction to the movement of the second arm along the first direction.

In an exemplary embodiment, the first arm includes one or more first slots each substantially parallel to the first surface, and the second arm includes one or more second slots each substantially parallel to the second surface. The button includes one or more first pins and one or more second pins. Each respective first pin in the one or more first pins is operably coupled with a corresponding first slot in the one or more first slots and movable along the corresponding first slot to guide the movement of the third surface with respect to the first surface of the first arm. Each respective second pin in the one or more second pins is operably coupled with a corresponding second slot in the one or more second slots and movable along the corresponding second slot to guide the movement of the fourth surface with respect to the second surface of the second arm.

In an exemplary embodiment, the first and second arms are substantially symmetric with respect to the button.

In some exemplary embodiments, the casing includes a cover, and the button is accessible from an exterior side of the cover.

In an exemplary embodiment, each of the first and second arms is substantially straight and elongated along the first direction, and each of the first end of the first arm and the second end of the second arm includes a curved or sloped surface.

In various exemplary embodiments, the present disclosure provides an adjustment mechanism including a casing, a first arm, a second arm, and a button. The casing includes a first side, a second side and a channel between the first and second sides. The first arm is disposed in the channel of the casing and movable with respect to the casing along a first direction. The first arm includes a first end adjacent to the first side of the casing, and one or more first slots sloped with respect to the first direction and a second direction substantially perpendicular to the first direction. The second arm is disposed in the channel of the casing and movable with respect to the casing along the first direction. The second arm includes a second end adjacent to the second side of the casing, and one or more second slots sloped with respect to the first direction and the second direction. The button is operably coupled with the first and second arms and movable with respect to the casing along the second direction. The button includes one or more first pins and one or more second pins. Each respective first pin in the one or more first pins is operably coupled with a corresponding first slot in the one or more first slots and movable along the corresponding first slot. Each respective second pin in the one or more second pins is operably coupled with a corresponding second slot in the one or more second slots and movable along the corresponding second slot. The one or more first pins and the one or more first slots collectively transfer the movement of the button along the second direction to the movement of the first arm along the first direction, thereby selectively pushing the first end of the first arm out of the first side of the casing. The one or more second pins and the one or more second slots collectively transfer the movement of the button along the second direction to the movement of the second arm along the first direction, thereby selectively pushing the second end of the second arm out of the second side of the casing.

In some exemplary embodiments, the first arm includes a third slot in the first direction, and the second arm includes a fourth slot in the first direction. The casing includes a third pin and a fourth pin. The third pin is operably coupled with the third slot and movable along the third slot to guide the movement of the first arm along the first direction. The fourth pin is operably coupled with the fourth slot and movable along the fourth slot to guide the movement of the second arm along the first direction.

In some exemplary embodiments, the adjustment mechanism further includes a second elastic member and a third elastic member. The second elastic member is disposed at the third slot of the first arm, and has a first end abutting the third pin and a second end abutting an end of the third slot that faces the first end of the first arm, thereby maintaining the first end of the first arm out of the first side of the casing in the absence of an external force. The third elastic member is disposed at the fourth slot of the second arm, the third elastic member having a first end abutting the fourth pin and a second end abutting an end of the fourth slot that faces the second end of the second arm, thereby maintaining the second end of the second arm out of the second side of the casing in the absence of an external force.

In an exemplary embodiment, the first arm includes a first protection piece coupled or integrally formed with the third slot of the first arm to prevent disengagement of the second elastic member from the third slot of the first arm. The second arm includes a second protection piece coupled or integrally formed with the fourth slot of the second arm to prevent disengagement of the third elastic member from the fourth slot of the second arm.

In various exemplary embodiments, the present disclosure provides an adjustable assembly including a first adjustable support, a second adjustable support and an adjustment mechanism disclosed herein. The first and second adjustable supports are spaced apart and substantially parallel to each other. Each of the first and second adjustable supports includes an outer tubular bar and an inner bar. The outer tubular bar includes a first restriction hole formed on a first wall of the outer tubular bar. The inner bar is telescopically coupled with the outer tubular bar and includes a plurality of restriction members formed at a first wall of the inner. The adjustment mechanism is disposed in between the first and second adjustable supports. The first side of the adjustment mechanism is coupled with the first adjustable support such that the first end of the first arm is selectively protruded out of the first side of the casing and selectively inserted into the first restriction hole of the outer tubular bar and any one respective restriction member in the plurality of restriction members of the inner bar of the first adjustable support, thereby selectively restricting movement of the inner bar with respect to the outer tubular bar of the first adjustable support. The second side of the adjustment mechanism is coupled with the second adjustable support such that the second end of the second arm is selectively protruded out of the second side of the casing and selectively inserted into the first restriction hole of the outer tubular bar and any one respective restriction member in the plurality of restriction members of the inner bar of the second adjustable support, thereby selectively restricting movement of the inner bar with respect to the outer tubular bar of the second adjustable support.

In some exemplary embodiments, of each of the first and second adjustable supports, the plurality of restriction members of the inner bar includes one or more one-way restriction structures. Each respective one-way restriction structure in the one or more one-way restriction structures includes a restriction slot and a restriction tongue. The restriction slot is formed at the first wall of the inner bar and includes a proximal edge toward the proximal end of the inner bar and a distal edge toward the distal end of the inner bar. The restriction tongue is integrally formed or connected with one of the proximal and distal edges of the restriction slot and curved inwardly with respect to the first wall of the inner bar along the length direction of the inner bar toward the other of the proximal and distal edges of the restriction slot, thereby allowing the adjustment mechanism to restrict the inner bar from moving with respect to the outer tubular bar in one direction but not the other.

In an exemplary embodiment, each of the first end of the first arm and the second end of the second arm includes a curved or sloped surface operably coupled with the restriction tongue of the respective one-way restriction structure of the inner bar to aid disengagement of the first end of the first arm and the second end of the second arm from the restriction slot at the one of the proximal and distal edges of the restriction slot.

The adjustment mechanisms, and structures (e.g., adjustable assemblies and tables) of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
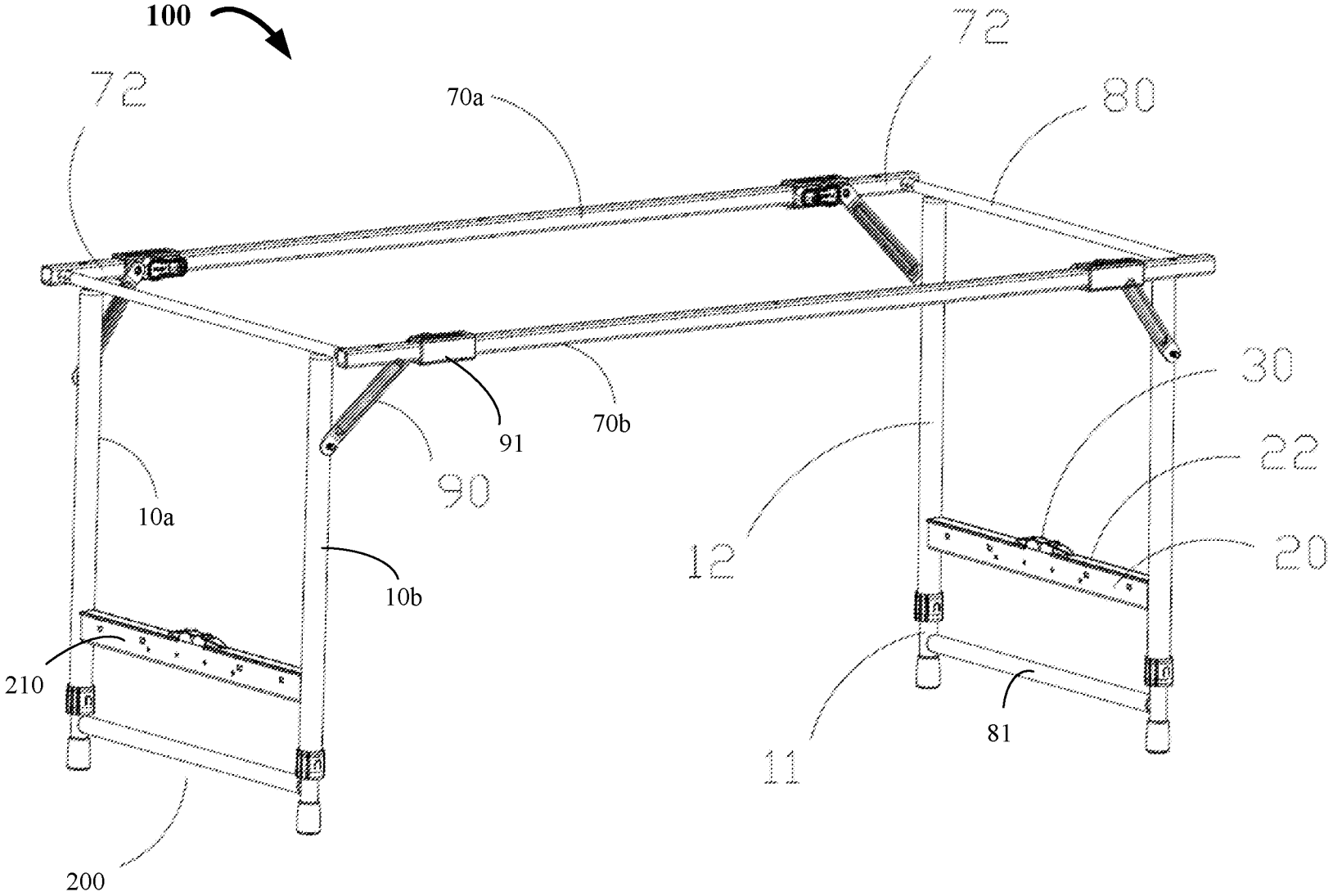
FIG. 1 is a perspective view illustrating an exemplary frame in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of adjustment mechanisms and structures having such adjustment mechanisms. An adjustment mechanism generally includes a casing, a first arm, a second arm and a button. The casing includes a channel. The first arm is movably disposed in the channel with the first end adjacent to the first side of the casing, and the second arm is movable disposed in the channel with the second end adjacent to the second side of the casing. The button is operably coupled with the first and second arms and configured to selectively push the first end of the first arm out of the first side of the casing and the second end of the second arm out of the second side of the casing. In some exemplary embodiments, an adjustment mechanism of the present disclosure includes means such as bias member(s) that maintains the button and thus the first and second arms at a desired state under normal conditions. As such, the adjustment mechanisms of the present disclosure provide an easy, convenient and safe means for adjusting a height or length of a structure such as adjustable assemblies.

An adjustable assembly of the present disclosure generally includes a first adjustable support, a second adjustable support, and an adjustment mechanism disclosed herein. The first and second adjustable supports are disposed substantially parallel to each other. Each of the first and second adjustable supports includes an inner bar and an outer bar telescopically coupled with each other. The adjustment mechanism is disposed in between the first and second adjustable supports, and has the first side coupled with the first adjustable support and the second side coupled with the second adjustable support. The adjustment mechanism selectively allows or restricts the relative movement of the inner and outer bars of the first and second adjustable support, and thus selectively allows or restricts the adjustment of the height or length of the adjustable assembly.

The adjustable assemblies of the present disclosure can be made of various materials including but not limited to metals (e.g., iron, steel, and aluminum) and plastics. They can be used in various structures including but not limited to frames and tables. The structures can be of various sizes and shapes and can be used for different purposes. For instance, a table can be a coffee table, a desk, a dining table, a picnic table or the like. With the adjustment mechanisms of the present disclosure, adjusting the height or a length of a structure is easy, simply and safe. For instance, one can adjust the height of a table by a simple operation of the button of the adjustment mechanism.

Referring now to FIG. 1, there is depicted an exemplary frame in accordance with some embodiments of the present disclosure. As shown, frame 100 includes side bars such as first side bar 70*a* and second side bar 70*d*. The first and second side bars are spaced apart from each other and can be used to couple and support other parts such as a tabletop or the like. Frame 100 also includes one or more adjustable assemblies such as adjustable assembly 200 to support the first and second side bars (and other parts such as the tabletop) above the ground, and to allow one to adjust the height of the first and second side bars (and other parts such as the tabletop) to meet one's need. For instance, FIG. 1 illustrates frame 100 including two adjustable assemblies 200. It should be noted that frame 100 can include any suitable number, shape, size, configuration and arrangement of adjustable assembly or assemblies depending on the intended use of the frame, preference, or the like.

In some exemplary embodiments, adjustable assembly 200 is pivotally connected with the first and second side bars such that the adjustable assembly can be rotated with respect to the first and second bars between a folded state and an unfolded state. For instance, in an exemplary embodiment, a crossbar such as crossbar 80 is disposed between the first and second side bars. The crossbar has a first end pivotally connected with the first side bar (e.g., at end portion 72 of the first side bar) and a second end pivotally connected with the second side bar. In an exemplary embodiment, the crossbar is a component of the adjustable assembly. In an exemplary embodiment, each of the first and second side bars is made of two or more bar segments telescopically connected with each other so that the lengths of the first and second side bars can be adjusted.

In some exemplary embodiments, to enhance the stability of the frame and/or to aid the rotation of the adjustable assembly with respect to the first and second side bars, frame 100 includes a plurality of oblique supports such as oblique support 90 and a plurality of sliders such as slider 91. Each slider is slidably coupled with the first or second side bar, and each oblique support has one end pivotally connected with a slider and another end pivotally connected with an adjustable assembly. The slider includes a locking/unlocking mechanism that selectively restricts movement of the slider along the first or second side bar at one or more desired positions, for instance, when the adjustable assembly is in the unfolded state. Examples of sliders and related features are disclosed in U.S. patent application Ser. No. 16/838,947, the disclosure of which is incorporated herein for all purposes by reference in its entirety.

Referring to FIGS. 1, 2, 7 and 8, in some exemplary embodiments, adjustable assembly 200 includes a first adjustable support such as first adjustable support 10*a*, a second adjustable support such as second adjustable support 10*b*, and an adjustment mechanism such as adjustment mechanism 210. The first and second adjustable supports are spaced apart and substantially parallel to each other. Each of the first and second adjustable supports includes an outer tubular bar such as outer tubular bar 12 and an inner bar such as inner bar 11 telescopically coupled with the outer tubular bar. The inner bar can be tubular or non-tubular. In some exemplary embodiments, the outer tubular bar of each of the first and second adjustable supports is connected with crossbar 80, for instance, at the distal end (e.g., the upper end in FIG. 2) of the outer tubular bar. In an exemplary embodiment, adjustable assembly 200 includes another crossbar such as crossbar 81. Crossbar 81 is disposed between the inner bars of the first and second adjustable supports and having one end connected with the inner bar of the first adjustable support and the other end connected with the inner bar of the second adjustable support.

Adjustment mechanism 210 is disposed between the first and second adjustable supports, having one end coupled with the first adjustable support and a second end coupled with the second adjustable support. The adjustment mechanism is configured to control the relative movement of the inner and outer bars of the first and second adjustable supports.

For instance, in some exemplary embodiments, the outer tubular bar includes a first restriction hole such as first restriction hole 13 formed on a first wall of the outer tubular bar. The first wall of the outer tubular bar of the first adjustable support refers to the side wall of the outer tubular bar facing the second adjustable support, and the first wall of the outer tubular bar of the second adjustable support refers to the side wall of the outer tubular bar facing the first adjustable support.

The inner bar includes a plurality of restriction members such as restriction member 212 formed at a first wall of the inner bar. Like the first wall of the outer tubular bar, the first wall of the inner bar of the first adjustable support refers to the side wall of the inner facing the second adjustable support, and the first wall of the inner bar of the second adjustable support refers to the side wall of the inner bar facing the first adjustable support. The plurality of restriction members is distributed along the length direction of the inner bar with uniform or non-uniform spacing. In some exemplary embodiments, the inner bar includes two, three, four, five or more than five restriction members.

Restriction member 212 can be configured in any suitable shape and size. For instance, in an exemplary embodiment, at least one restriction member 212 is configured similarly to the first restriction hole of the outer tubular bar. In another exemplary embodiment, at least one restriction member 212 is configured to be a one-way restriction structure including a restriction slot such as restriction slot 14 and a restriction tongue such as restriction tongue 15. In still another exemplary embodiment, the inner bar includes any suitable combination of restriction holes and one-way restriction structures. In an exemplary embodiment, the restriction tongue has a curved or sloped surface 16 facing the first wall of the outer tubular. The restriction slot is formed at the first wall of the inner bar and including a proximal edge toward the proximal end (i.e., the end disposed inside of the outer tubular bar) of the inner bar and a distal edge toward the distal end (i.e., the end disposed outside of the outer tubular bar) of the inner bar. The restriction tongue is integrally formed or connected with one of the proximal and distal edges of the restriction slot and curved inwardly with respect to the first wall of the inner bar along the length direction of the inner bar toward the other of the proximal and distal edges of the restriction slot. Examples of one-way restriction structures and related features are disclosed in U.S. patent application Ser. No. 15/931,925, the disclosure of which is incorporated herein for all purposes by reference in its entirety. With such a one-way restriction structure, the adjustment mechanism can selectively restrict the inner bar from moving with respect to the outer tubular bar in one direction but not the other.

Referring to FIGS. 2, 3 6 and 7, adjustment mechanism 210 has a first side coupled with the first adjustable support adjacent to the first restriction hole of the outer tubular bar of the first adjustable support, and a second side coupled with the second adjustable support adjacent to the first restriction hole of the outer tubular bar of the second adjustable support. The first side of the adjustment mechanism is configured to selectively restrict movement of the inner bar with respect to the outer tubular bar of the first adjustable support, and the second side of the adjustment mechanism is configured to selectively restrict movement of the inner bar with respect to the outer tubular bar of the second adjustable support.

For instance, in some exemplary embodiments, adjustment mechanism 210 includes a casing such as casing 20, a first arm such as first arm 40*a*, a second arm such as second arm 40*b* and a button such as button 30. The casing includes a first side disposed adjacent to the first adjustable support and a second side disposed adjacent to the second adjustable support. The casing also includes a channel such as channel 21 between the first and second sides of the casing. The first restriction holes of the outer tubular bars of the first and second adjustable supports are accessible through the channel of the casing. In some exemplary embodiments, adjustment mechanism 210 includes a cover such as cover 22 coupled with the casing to encase the first and second arms.

First arm 40*a* and second arm 40*b* are disposed in the channel of the casing. The first arm has a first end such as first end 47*a* adjacent to the first side of the casing, and the second arm has a second end such as second end 47*b* adjacent the second side of the casing. The first and second arms are movable with respect to the casing along the first direction (e.g., the x-direction in FIG. 2). As the first arm moves toward the first adjustable support, the first end of the first arm can protrude from the first side of the casing and be inserted into the first restriction hole of the outer tubular bar and a restriction member of the inner bar of the first adjustable support. Similarly, as the second arm moves toward the second adjustable support, the second end of the second arm can protrude from the second side of the casing and be inserted into the first restriction hole of the outer tubular bar and a restriction member of the inner bar of the second adjustable support. In an exemplary embodiment, cover 22 helps to prevent the first and second arms from moving in directions other than the first direction.

In the illustrated embodiments, each of the first and second arms is substantially straight and elongated along the first direction, and the first and second arms are be substantially the same as each other and substantially symmetric to each other. It should be noted that this is a non-limiting example. The first and second arms can have any suitable configurations, e.g., any suitable sizes and shapes. In addition, the first and second arms can be but do not have to be substantially the same as each other and substantially symmetric to each other. For instance, the first and second arms can have different dimensions along the first direction and thus be asymmetric to each other.

Figure 2:
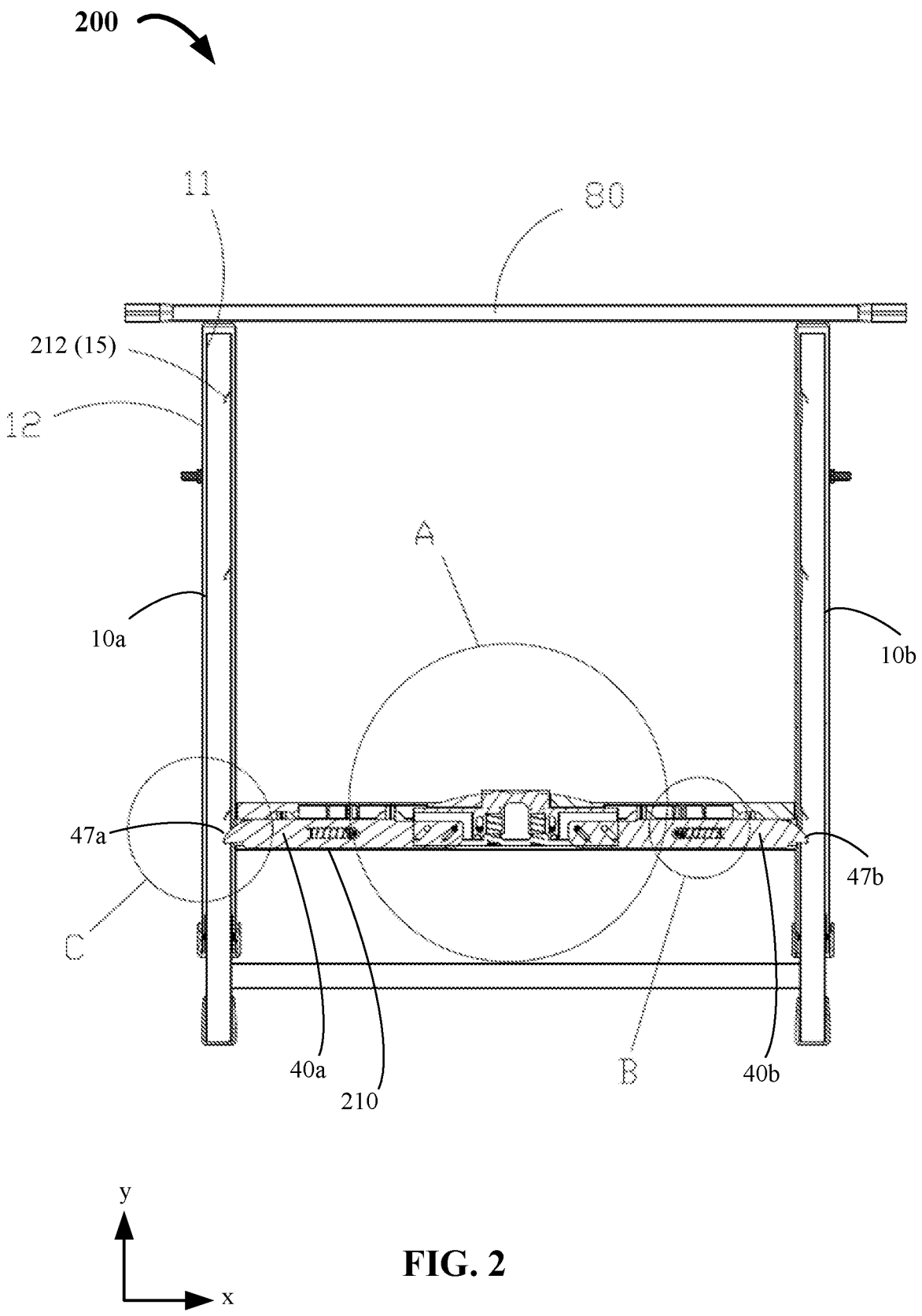
FIG. 2 is a partially cutout view illustrating an exemplary adjustable assembly in accordance with exemplary embodiments of the present disclosure.

Button 30 is operably coupled with the first and second arms, and is accessible and operable externally, e.g., by a person. The button is movable with respect to the casing along a second direction (e.g., the y-direction in FIG. 2) that is substantially perpendicular to the first direction between a first position and a second position. The first position of the button corresponds to a locking state at which the end of the first or second arm is protruded out of the casing and inserted into the first restriction hole of the outer tubular bar and a restriction member of the inner bar of the respective adjustable support, thereby restricting relative movement of the inner and outer bars in at least one direction. The second position of the button corresponds to an unlocking state at which the end of the first or second arm is disengaged from the inner bar and/or the outer tubular bar, thereby allowing relative movement of the inner and outer bars. FIG. 2 illustrates the button at the first position. Pressing the button downward toward the bottom of the casing will place the button in the second position.

The first arm, second arm and button are configured such that the movement of the button along the second direction will cause the movement of the first and second arms along the first direction. For instance, in some exemplary embodiments, the first arm includes one or more first slots such as first slot 41*a* sloped with respect to the first and second directions (e.g., not parallel to either the first or second direction), and the second arm includes one or more second slots such as second slot 41*b* sloped with respect to the first and second directions. In an exemplary embodiment, the first and second slots are symmetric with respect to the button. The button includes one or more first pins such as first pin 51*a* and one or more second pins such as second pin 51*b*. The first or second pins can be integrally formed or coupled with a body of the button. First pin 51*a* is operably coupled with first slot 41*a* and movable along the first slot. Second pin 51*b* is operably coupled with second slot 41*b* and movable along the second slot. It should be noted that pins and slots can be switched. For instance, in an exemplary embodiment, the button includes first slot 41*a* and second slot 41*b* whereas the first arm includes first pin 51*a* and the second arm includes second pin 51*a*.

As the button moves downward (e.g., toward the bottom of the casing) from the first position, the first and second pins move downward as well. Because the first slot(s) is sloped, the downward movement of the first pin(s) pushes the first arm toward the second arm (away from the first adjustable support) and thus pulls the first end of the first arm out of the restriction member of the inner bar and/or the first restriction hole of the outer tubular bar of the first adjustable support. Similarly, because the second slot(s) is sloped, the downward movement of the second pin(s) pushes the second arm toward the first arm (away from the second adjustable support) and thus pulls the second end of the second arm out of the restriction member of the inner bar and/or the first restriction hole of the outer tubular bar of the second adjustable support. At this state, the inner bar is movable with respect to the outer tubular bar of the respective adjustable support in both directions, e.g., toward or away from the outer tubular bar.

Conversely, as the button moves upward from the second position, the first and second pins move upward as well. Because the first slot(s) is sloped and the first arm is movable in the first direction, the upward movement of the first pin(s) pushes the first arm toward the first adjustable support and thus pushes the first end of the first arm out of the first side of the casing and into the first restriction hole of the outer tubular bar and the restriction member of the inner bar of the first adjustable support. Similarly, because the second slot(s) is sloped and the second arm is movable in the first direction, the upward movement of the second pin(s) pushes the second arm toward the second adjustable support and thus pushes the second end of the second arm out of the second side of the casing and into the first restriction hole of the outer tubular bar and the restriction member of the inner bar of the second adjustable support. In this state, depending on the configuration of the restriction member of the inner bar, the inner bar is restricted from moving with respect to the outer tubular bar of the respective adjustable support in at least one direction.

For instance, if the restriction member of the inner bar is configured to be a restriction hole or slot, e.g., similar to first restriction hole 13, restriction slot 14 (without restriction tongue 15) or the like, the inner bar is restricted from moving with respect to the outer tubular bar of the respective adjustable support in both directions, e.g., toward or away from the outer tubular bar. In other words, the respective adjustable support is not allowed to adjust its length or height. On the other hand, if the restriction member of the inner bar is configured to be a one-way restriction structure including a slot such as restriction slot 14 and a guide such as restriction tongue 15, the inner bar is restricted from moving with respect to the outer tubular bar of the respective adjustable support in one direction. Depending on the position of the restriction tongue (e.g., whether at the proximal or distal edge of the restriction slot), the restriction tongue allows the inner bar to move away from the outer tubular bar (thus elongating the adjustable bar) or to move toward the outer tubular bar. In the embodiments illustrated in FIGS. 2 and 5, the restriction tongue is formed at the proximal edge of the restriction slot. As such, the inner bar is allowed to move away from the outer tubular bar. In other words, the respective adjustable support is allowed to increase its length or height, but not allowed to decrease its length or height.

Figure 5:
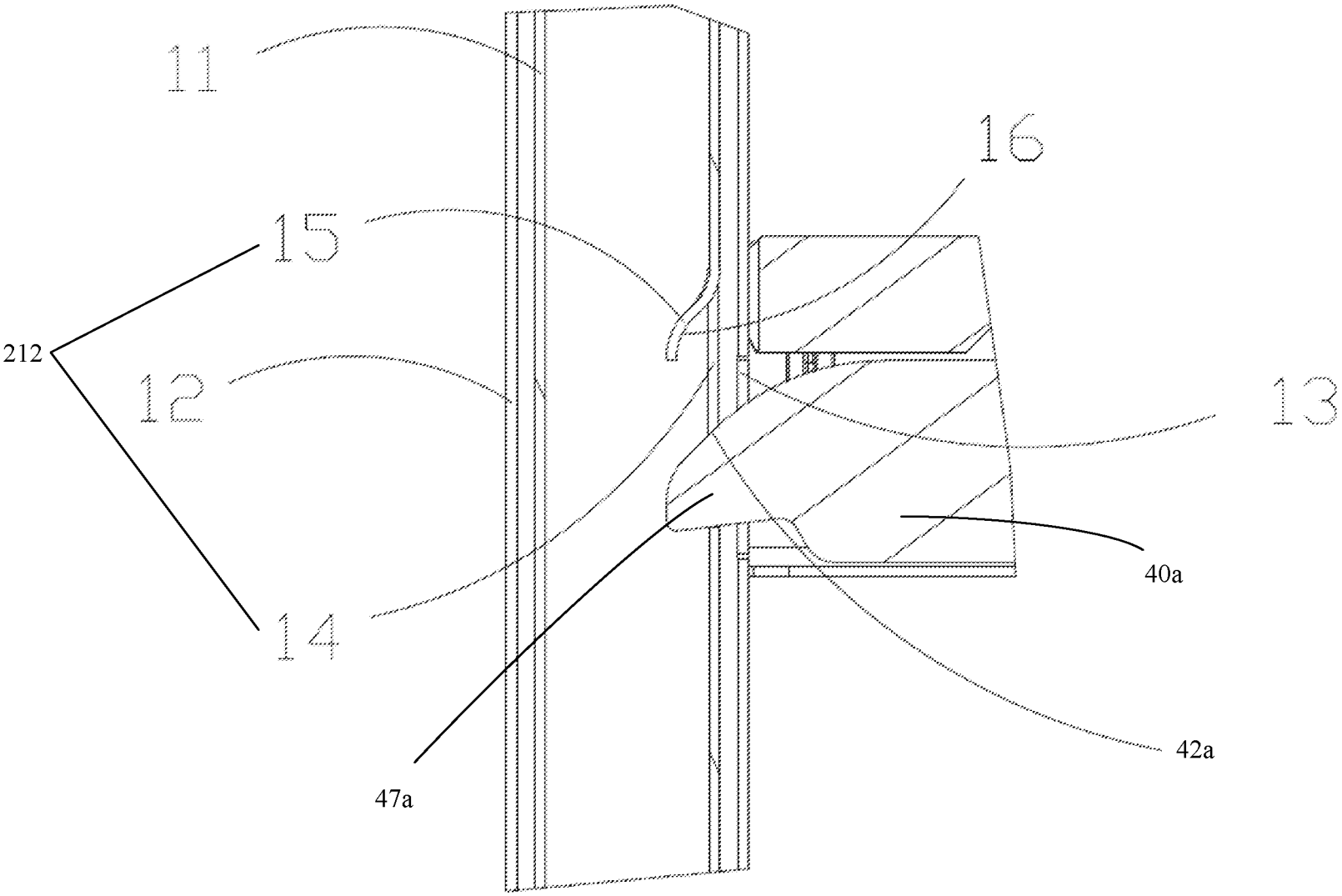
FIG. 5 is an enlarged view taken along circle C of FIG. 2.
Figure 6:
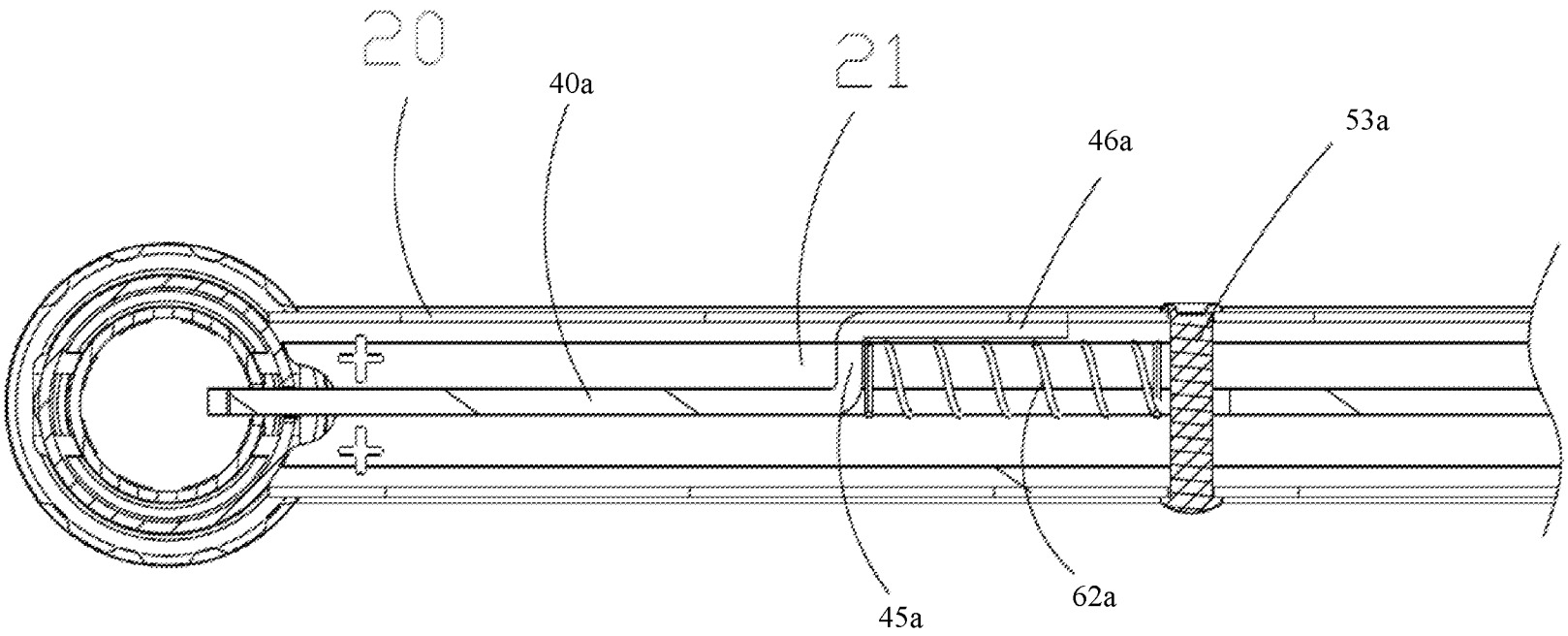
FIG. 6 is a partially cutout view illustrating a portion of the exemplary adjustable assembly of FIG. 2.
Figure 7:
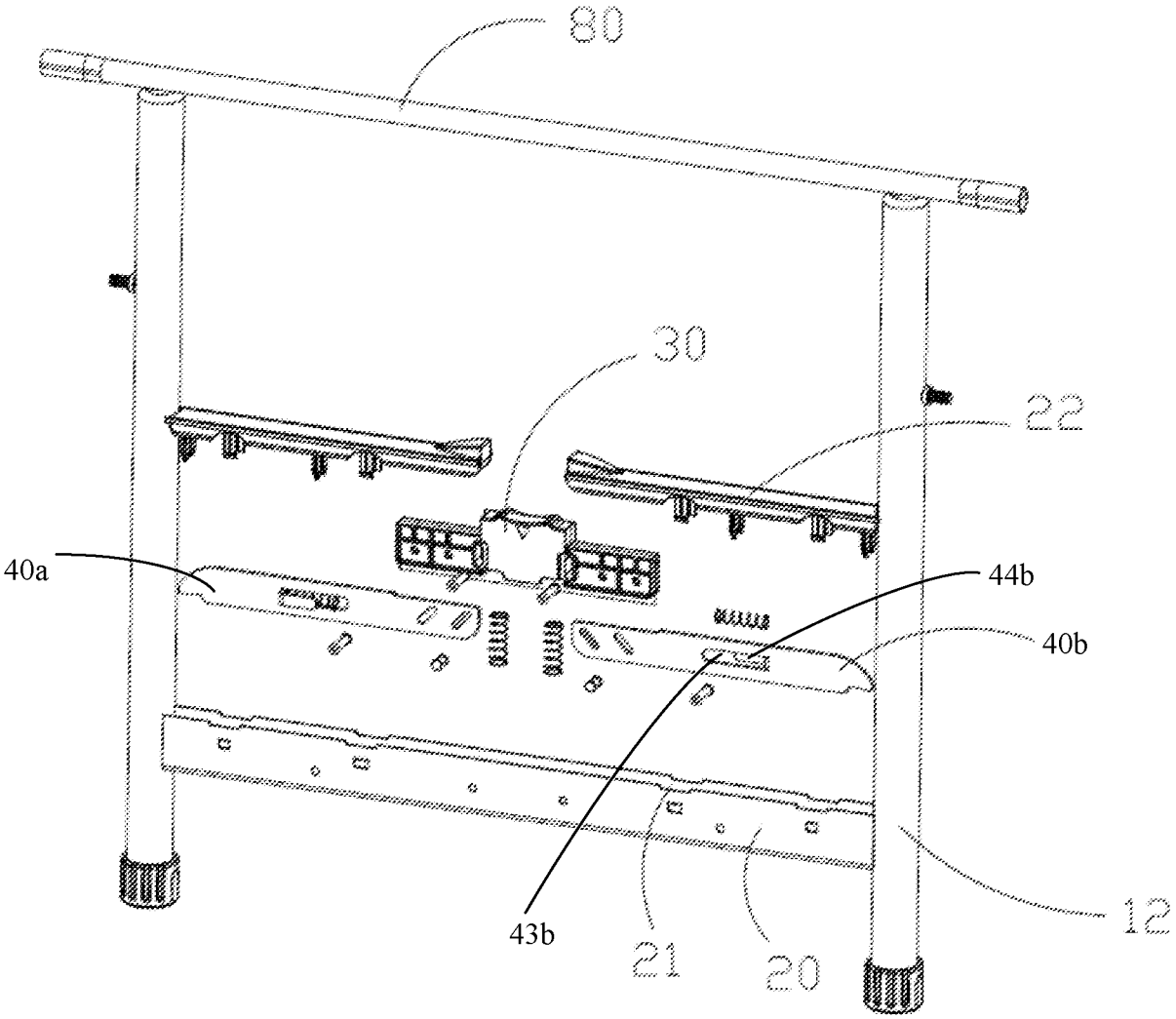
FIG. 7 is a partially disassembled view illustrating the exemplary adjustable assembly of FIG. 2.
Figure 8:
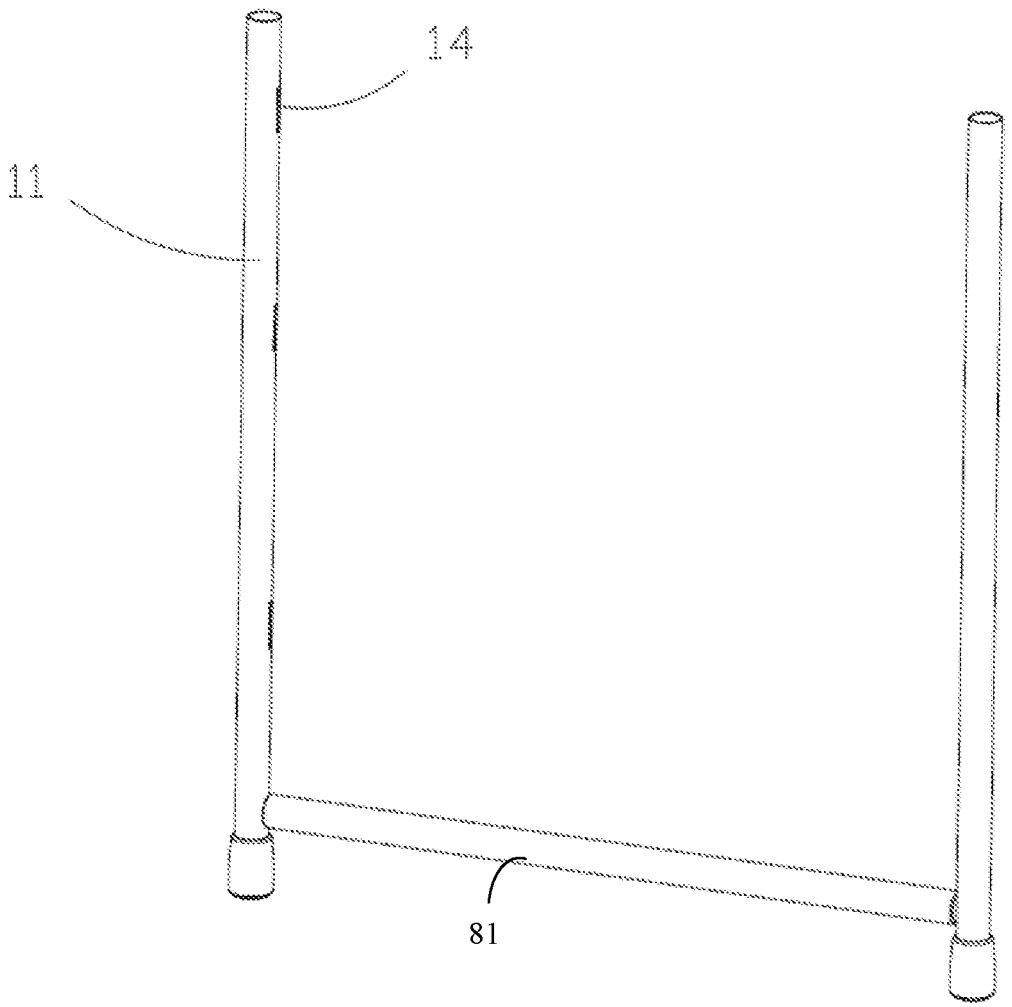
FIG. 8 is a perspective view illustrating some components of the exemplary adjustable assembly of FIG. 2.
Figure 9:
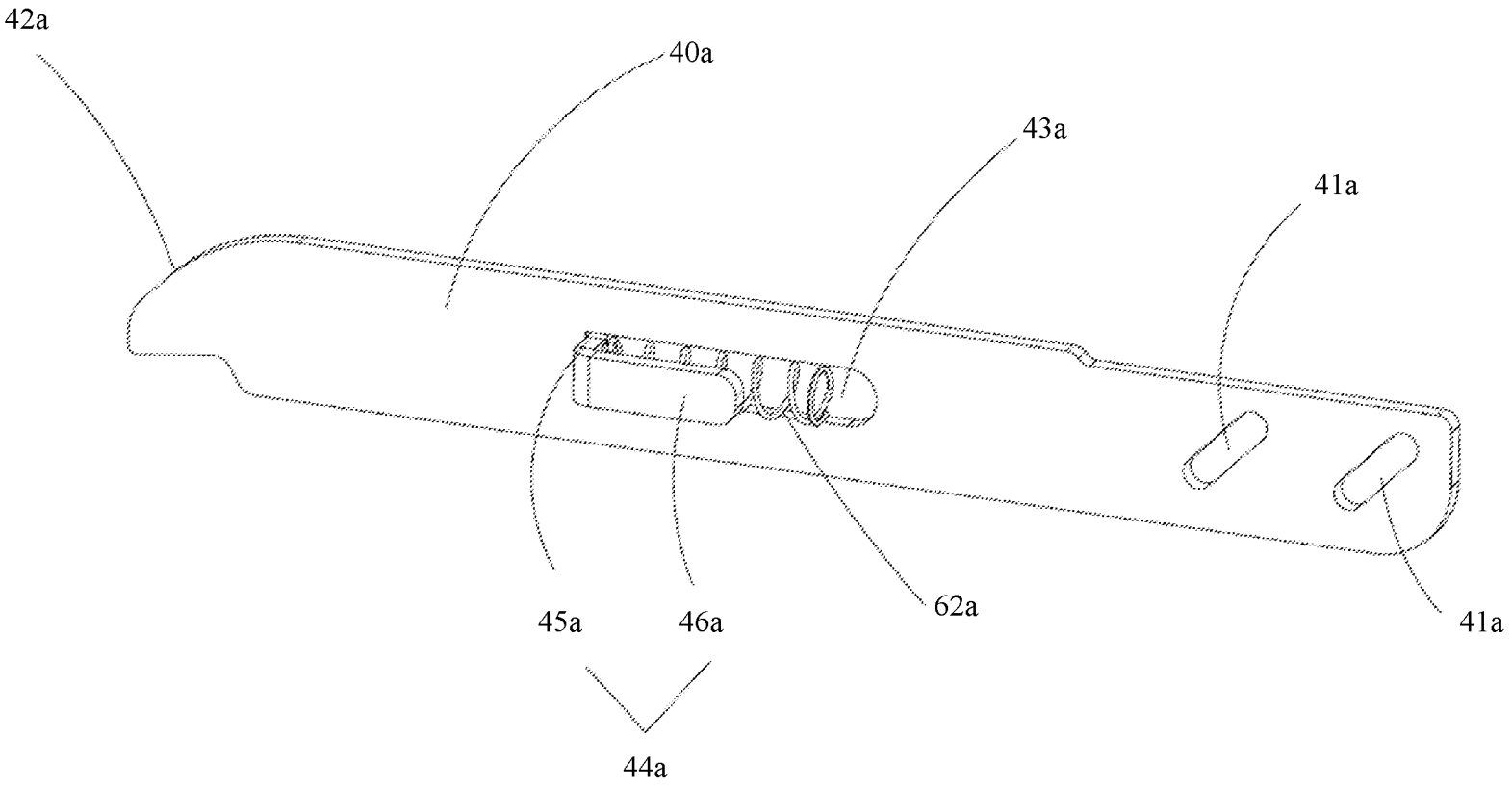
FIG. 9 is a perspective view illustrating some components of the exemplary adjustable assembly of FIG. 2.

In an exemplary embodiment, to aid disengagement of the end of the first or second arm from the restriction slot, the end of the first or second arm includes a curved surface operably coupled with the restriction tongue of the inner bar. For instance, by way of example, FIGS. 2 and 5 illustrate the first end of the first arm includes a curved or sloped surface such as surface 42*a* configured to be operably coupled with surface 16 of restriction tongue 15 of the inner bar at the proximal edge of the restriction slot. Surface 16 and surface 42*a* cooperatively pushes the first end of the first arm out of the restriction slot, thereby disengaging the inner bar from the outer tubular bar, allowing the inner bar to move away from the outer tubular bar.

Figure 3:
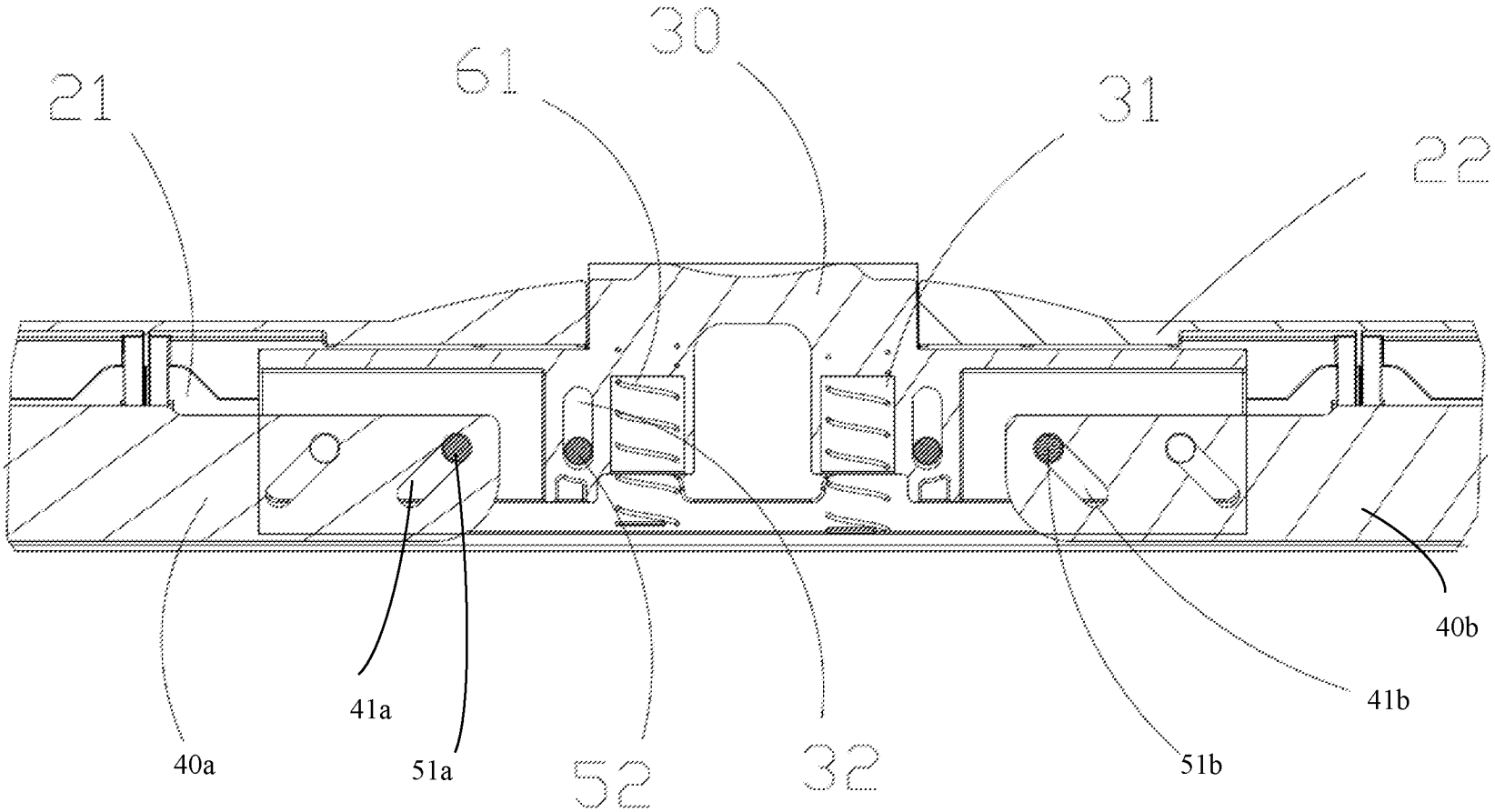
FIG. 3 is an enlarged view taken along circle A of FIG. 2.
Figure 4:
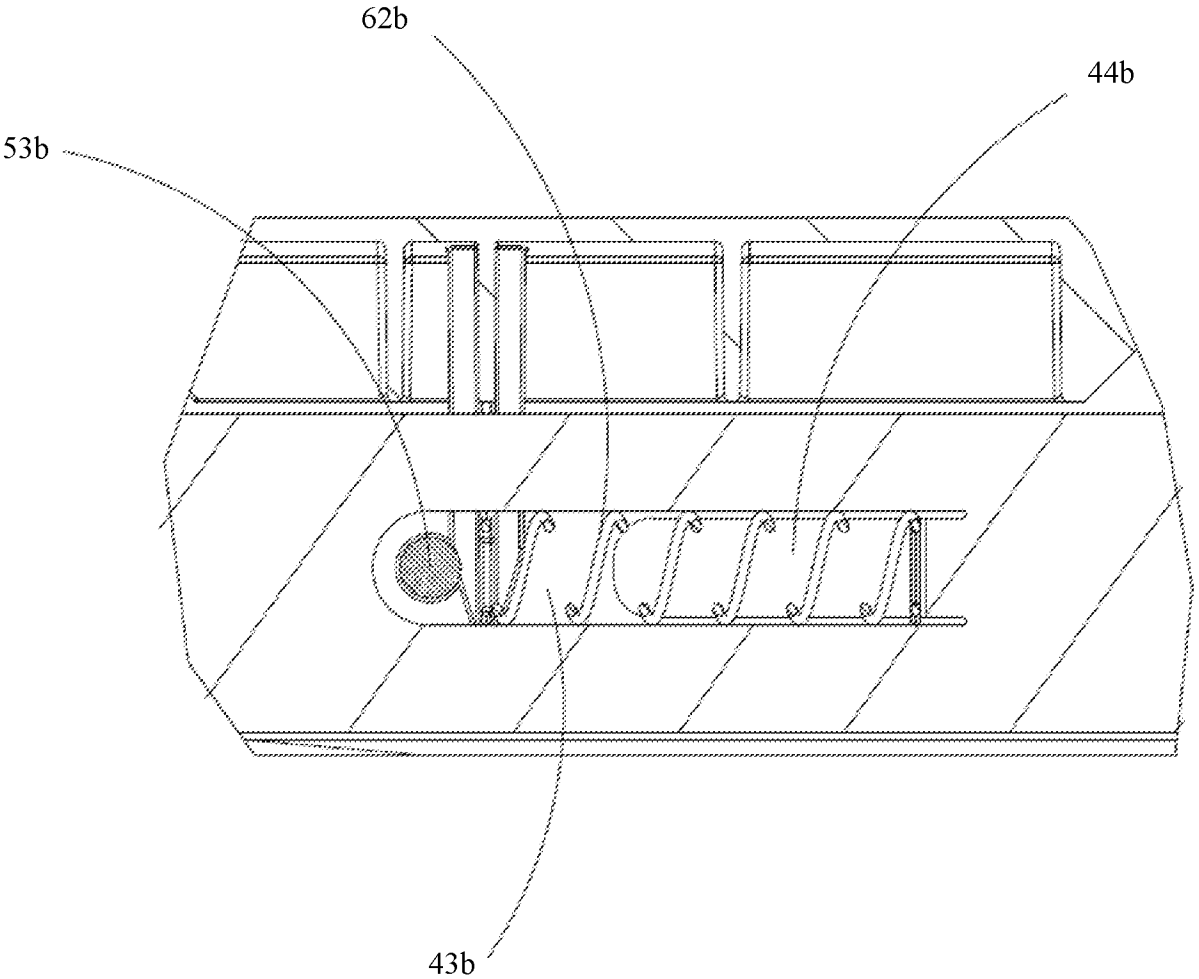
FIG. 4 is an enlarged view taken along circle B of FIG. 2.

In some exemplary embodiments, to place and keep the button at the first position under normal conditions (e.g., without an external force pressing the button), the adjustment mechanism includes one or more first elastic members (e.g., string) such as first elastic member 61. By way of example, FIG. 3 illustrates two first elastic members. First elastic member 61 has a first end abutting the casing and a second end abutting the button. The abutting can be direct or indirect. Because of the elastic force, the one or more first elastic members hold the button at the first position in the absence of an external force. As such, the first end of the first arm remains outside of the first side of the casing and the second end of the second arm remains outside of the second side of the casing and remains in the first restriction hole of the outer tubular bar and the restriction member of the inner bar of the corresponding adjustable support.

In an exemplary embodiment, the button includes one or more cavities such as cavity 31. Cavity 31 is configured to accommodate at least a portion of first elastic member 61.

In some exemplary embodiments, the button includes one or more slots such as slot 32 in the second direction and the casing includes one or more pins such as pin 52 operably coupled with the one or more slots of the button. Pin 52 can be integrally formed or coupled, for instance, with the walls of the channel of the casing. Pin 52 is movable along slot 32 to guide the movement of the button in the second direction.

Referring to FIGS. 2, 4, 6-7 and 9, in some exemplary embodiments, one or each of the first and second arms includes one or more slots in the first direction, and the casing includes one or more pins operably coupled with the one or more slots of the first or second arm to guide the movement of the first or second arm in the first direction. For instance, in some exemplary embodiments, first arm 40*a* includes a third slot such as slot 43*a* in the first direction, and casing 20 includes a third pin such as pin 53*a* operably coupled with slot 43*a*. The one or more third pins can be integrally formed or coupled, for instance, with the walls of the channel of the casing. Pin 53*a* is movable along slot 43*a* to guide the movement of the first arm along the first direction (e.g., the x-direction in FIG. 2).

In some exemplary embodiments, the adjustment mechanism includes a second elastic member such as elastic member 62*a* disposed at a third slot of the first arm. The second elastic member has a first end abutting the third pin and a second end abutting an end of the third slot that faces the first end of the first arm. The abutting can be direct or indirect. Because of the elastic force, the second elastic member pushes the first end of the first arm toward the first adjustable support. In some exemplary embodiments, in the absence of any external force, the second elastic member, alone or together with first elastic member 61, pushes the first end of the first arm out of the first side of the casing and into the first restriction hole of the outer tubular bar and the restriction member of the inner bar of the first adjustable support.

In some exemplary embodiments, the first arm includes a first protection piece coupled or integrally formed with the third slot of the first arm to prevent disengagement of the second elastic member from the third slot of the first arm. For instance, as illustrated FIGS. 6 and 9, in some exemplary embodiments, the first arm includes first protection piece 44*a* integrally formed with third slot 43*a*. In an exemplary embodiment, first protection piece 44*a* includes first portion 45*a* and second portion 46*a*. The first portion is connected with an edge of the third slot and the second portion is substantially parallel to the third slot. Together with the edges of the third slot, the first protection piece holds the second elastic member in the third slot of the first arm.

Similarly, in some exemplary embodiments, second arm 40*b* includes a fourth slot such as fourth slot 43*b* in the first direction, and casing 20 includes a fourth pin such as pin 53*b* operably coupled with the fourth slot. Like the third pin, the fourth pin can be integrally formed or coupled, for instance, with the walls of the channel of the casing. The fourth pin is movable along the fourth slot to guide the movement of the second arm along the first direction. It should be noted that pins and slots can be switched. For instance, in an exemplary embodiment, the casing includes third slot 43*a* and fourth slot 43*b* whereas the first arm includes third pin 53*a* and the second arm includes fourth pin 53*b*.

In some exemplary embodiments, the adjustment mechanism includes a third elastic member such as elastic member 62*b* disposed at a fourth slot of the second arm. The third elastic member has a first end abutting the fourth pin and a second end abutting an end of the fourth slot that faces the second end of the second arm. The abutting can be direct or indirect. Because of the elastic force, the third elastic member pushes the second end of the second arm toward the second adjustable support. In some exemplary embodiments, in the absence of any external force, the third elastic member, alone or together with first elastic member 61, pushes the second end of the second arm out of the second side of the casing and into the first restriction hole of the outer tubular bar and the restriction member of the inner bar of the second adjustable support.

In some exemplary embodiments, the second arm includes a second protection piece coupled or integrally formed with the fourth slot of the second arm to prevent disengagement of the third elastic member from the third slot of the first arm. For instance, as illustrated FIG. 7, in some exemplary embodiments, the second arm includes second protection piece 44*b* integrally formed with third slot 43*b*. Similar to first protection piece 44*a*, in an exemplary embodiment, the second protection piece includes a first portion connected with an edge of the fourth slot and a second portion substantially parallel to the fourth slot. Together with the edges of the fourth slot, the second protection piece holds the third elastic member in the fourth slot of the second arm.

Figure 10:
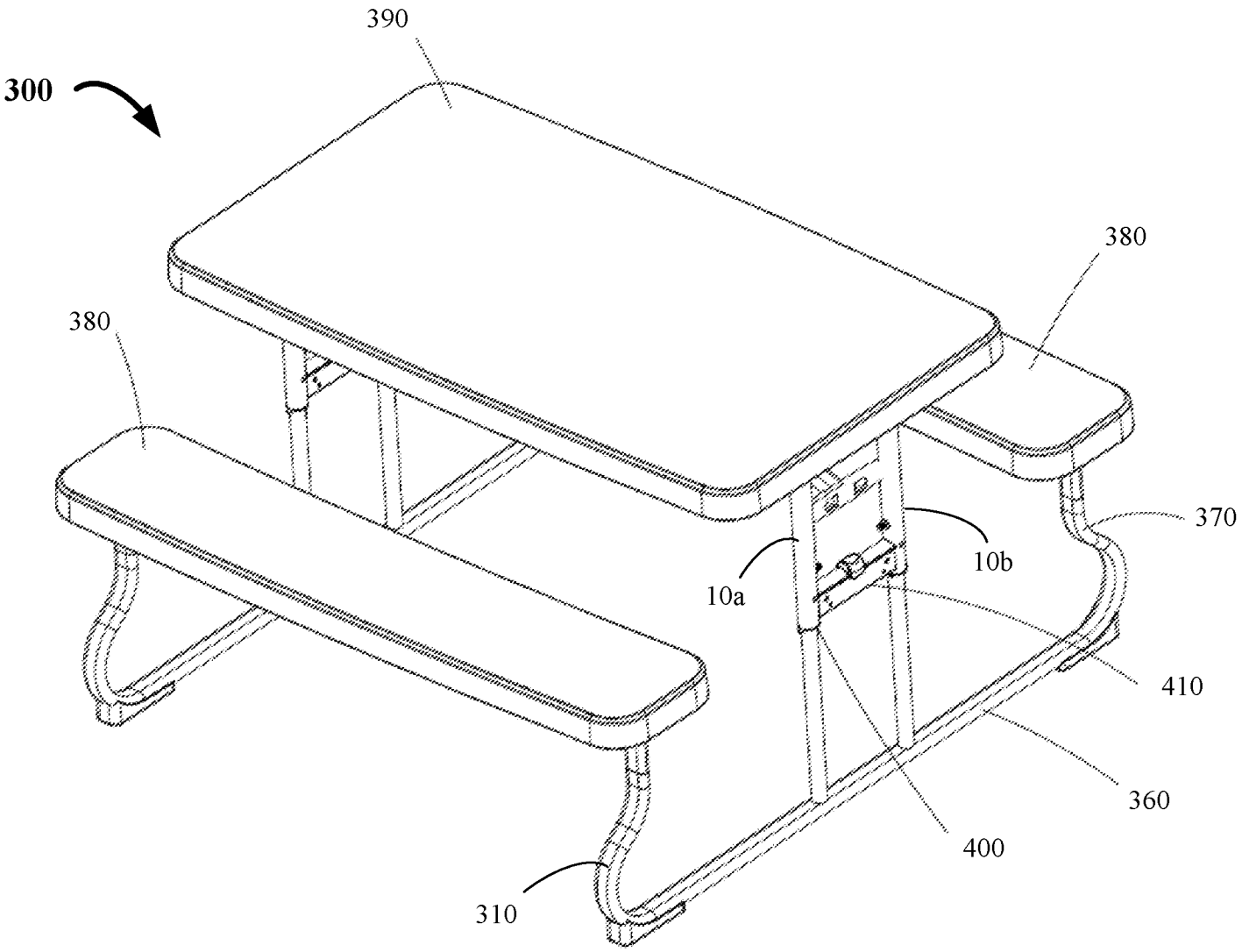
FIG. 10 is a perspective view illustrating an exemplary picnic table in accordance with exemplary embodiments of the present disclosure.

Referring now to FIG. 10, there is depicted an exemplary picnic table in accordance with some embodiments of the present disclosure. As shown, picnic table 300 includes a table panel such as table panel 390 and one or more bench panels such as bench panel 380. The table and bench panels can be of various shapes including but not limited to a square shape, a round shape or a rectangular shape, and can be made of various materials including but not limited to metals, plastics and woods. In some exemplary embodiments, the table panel, the bench panel or both are made of plastics by injection molding, blow molding or any other suitable processes.

Picnic table 300 also includes one or more frames such as frame 310 to support the table and bench panels. In some exemplary embodiments, frame 310 includes an adjustable assembly such as adjustable assembly 400 to support the table panel and allow one to adjust the height of the table panel to meet one's need. Frame 310 also includes one or more bench supports such as bench support 370. For instance, in the illustrated embodiment, frame 310 includes two bench supports 370, each supporting a corresponding bench panel 380. In an exemplary embodiment, a crossbar such as crossbar 360 is disposed between the two bench supports and integrally formed or connected with the bench supports.

Figure 11:
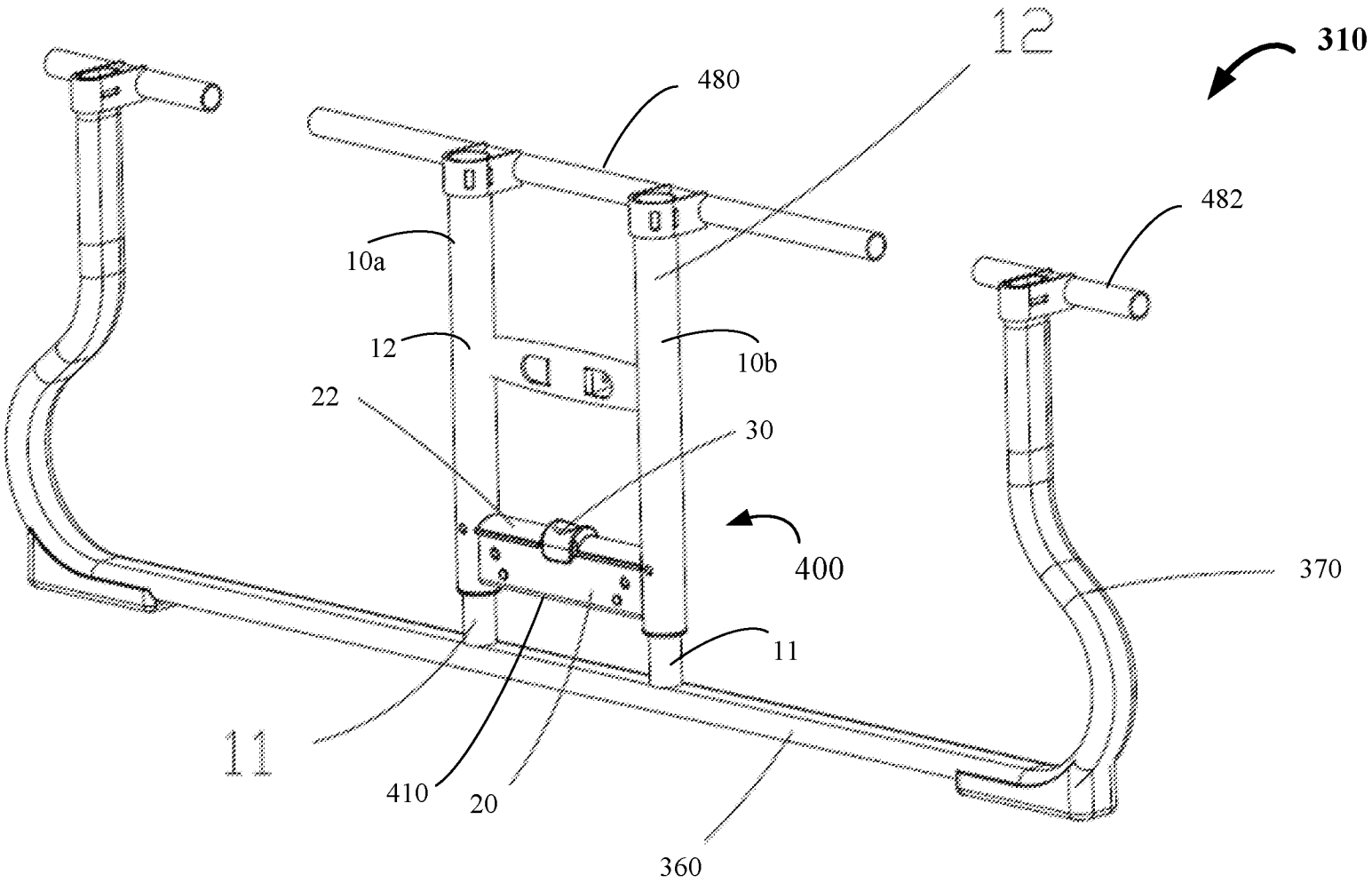
FIG. 11 is a perspective view illustrating an exemplary frame used in the picnic table of FIG. 10.
Figure 12:
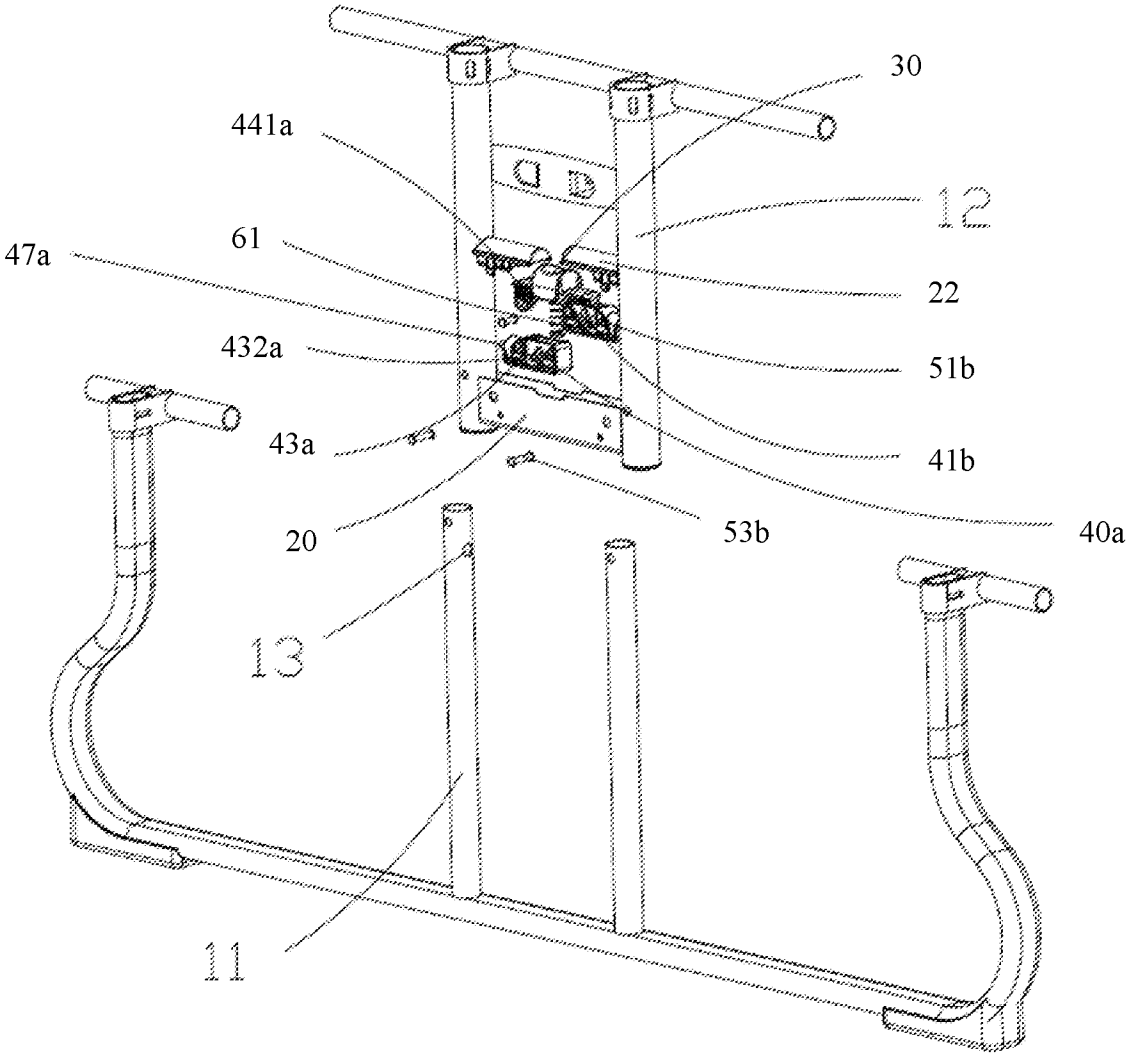
FIG. 12 is a partially disassembled view illustrating the exemplary frame of FIG. 11.
Figure 12A:
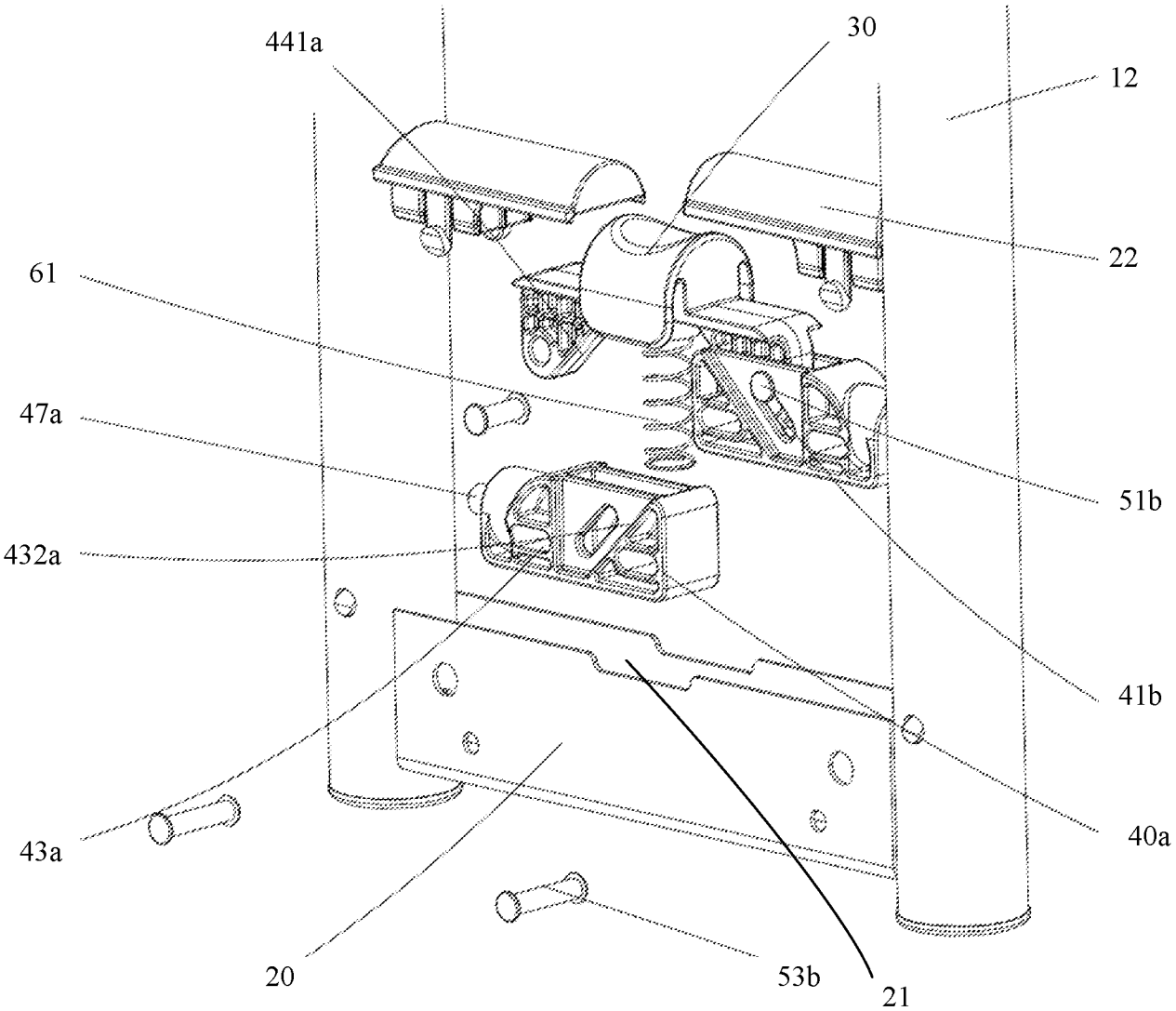
FIG. 12A is a partially enlarged view of FIG. 12 illustrating an exemplary adjustment mechanism in accordance with exemplary embodiments of the present disclosure.
Figure 13:
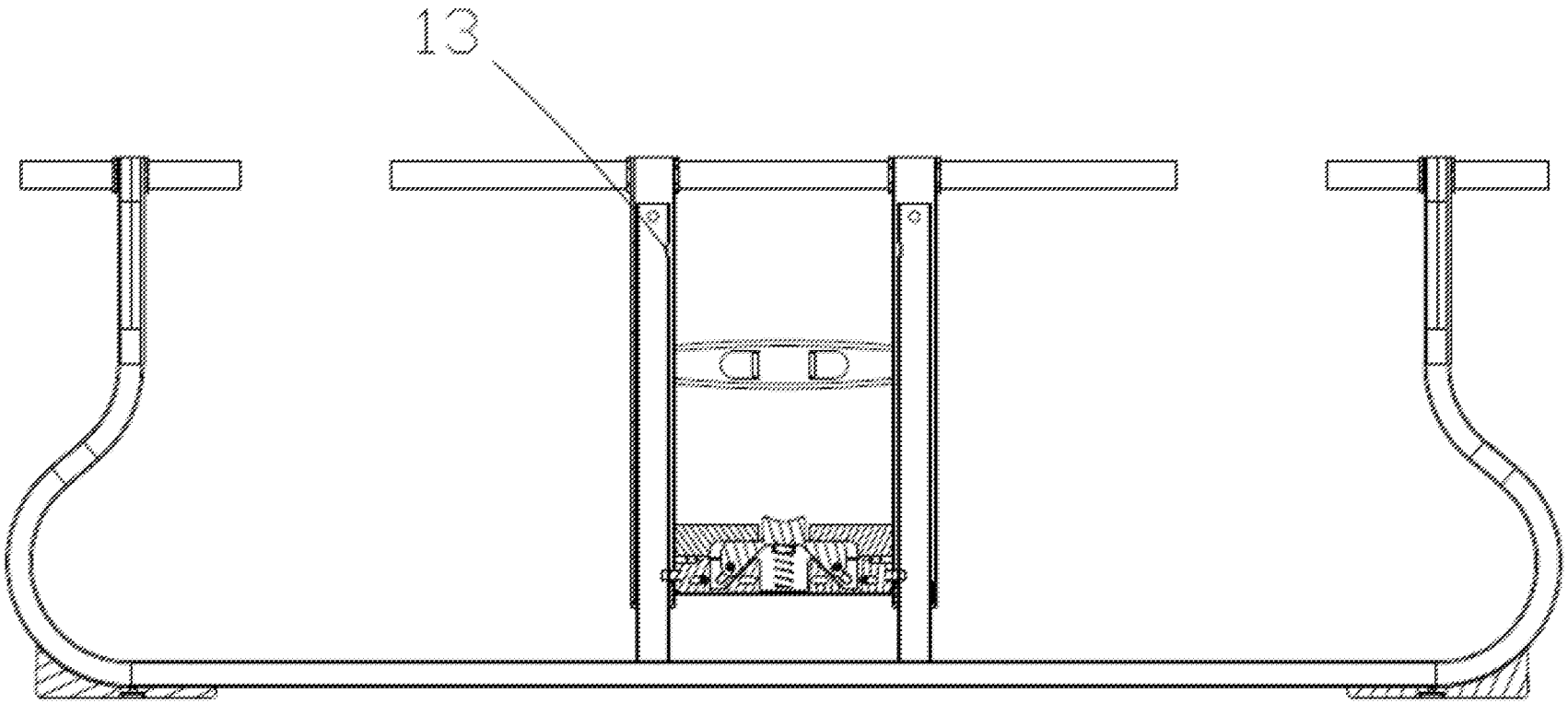
FIG. 13 is a partially cutout side view illustrating the exemplary frame of FIG. 11.

Referring to FIG. 11, in some exemplary embodiments, adjustable assembly 400 includes a first adjustable support such as first adjustable support 10*a*, a second adjustable support such as second adjustable support 10*b*, and an adjustment mechanism such as adjustment mechanism 410. In an exemplary embodiment, the lower end of adjustable assembly 400 (e.g., the distal ends of inner bars 11 of first adjustable support 10*a* and second adjustable support 10*b*) are connected with crossbar 360.

In some exemplary embodiments, frame 310 includes one or more additional crossbars. For instance, frame 310 includes crossbar 480 to couple or support the table panel. In an exemplary embodiment, the upper end of adjustable assembly 400 (e.g., the distal ends of outer tubular bars 12 of first adjustable support 10*a* and second adjustable support 10*b*) are connected with crossbar 380. In some exemplary embodiments, frame 310 further includes crossbar 482 coupled with bench support 370 and configured to couple or support the bench panel.

Referring to FIGS. 11-15, similar to adjustment mechanism 210, adjustment mechanism 410 is disposed between the first and second adjustable supports, having one end coupled with the first adjustable support and a second end coupled with the second adjustable support. The adjustment mechanism is configured to control the relative movement of the inner and outer bars of the first and second adjustable supports, and consequently control the height of the table panel. For instance, in some exemplary embodiments, adjustment mechanism 410 includes a casing such as casing 20, a first arm such as first arm 40*a*, a second arm such as second arm 40*b* and a button such as button 30. The casing includes a first side disposed adjacent to the first adjustable support and a second side disposed adjacent to the second adjustable support. The casing also includes a channel such as channel 21 between the first and second sides of the casing. The first restriction holes of the outer tubular bars of the first and second adjustable supports are accessible through the channel of the casing. In an exemplary embodiment, adjustment mechanism 410 includes a cover such as cover 22 coupled with the casing to encase the first and second arms.

First arm 40*a* and second arm 40*b* are disposed in the channel of the casing. The first arm has a first end such as first end 47*a* adjacent to the first side of the casing, and the second arm has a second end such as second end 47*b* adjacent the second side of the casing. The first and second arms can have any suitable shapes, sizes or the like. In the illustrated embodiments, the first and second arms have a block-like shape each with a pin-like end. The first and second arms are movable with respect to the casing along the first direction (e.g., the x-direction in FIG. 14).

Figure 14:
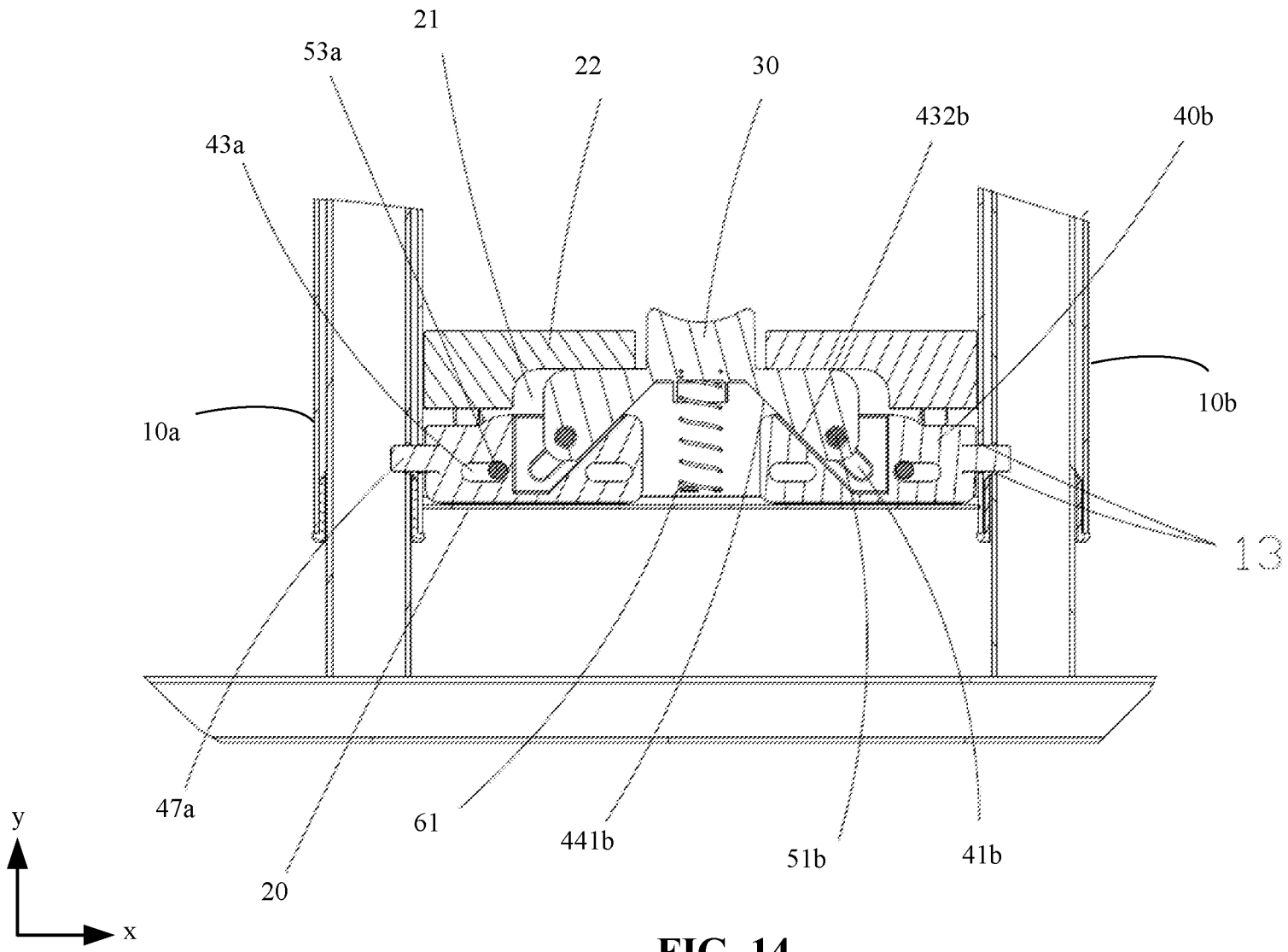
FIG. 14 is a partially enlarged cutout side view illustrating an exemplary adjustment mechanism in a locked state in accordance with exemplary embodiments of the present disclosure.
Figure 16:
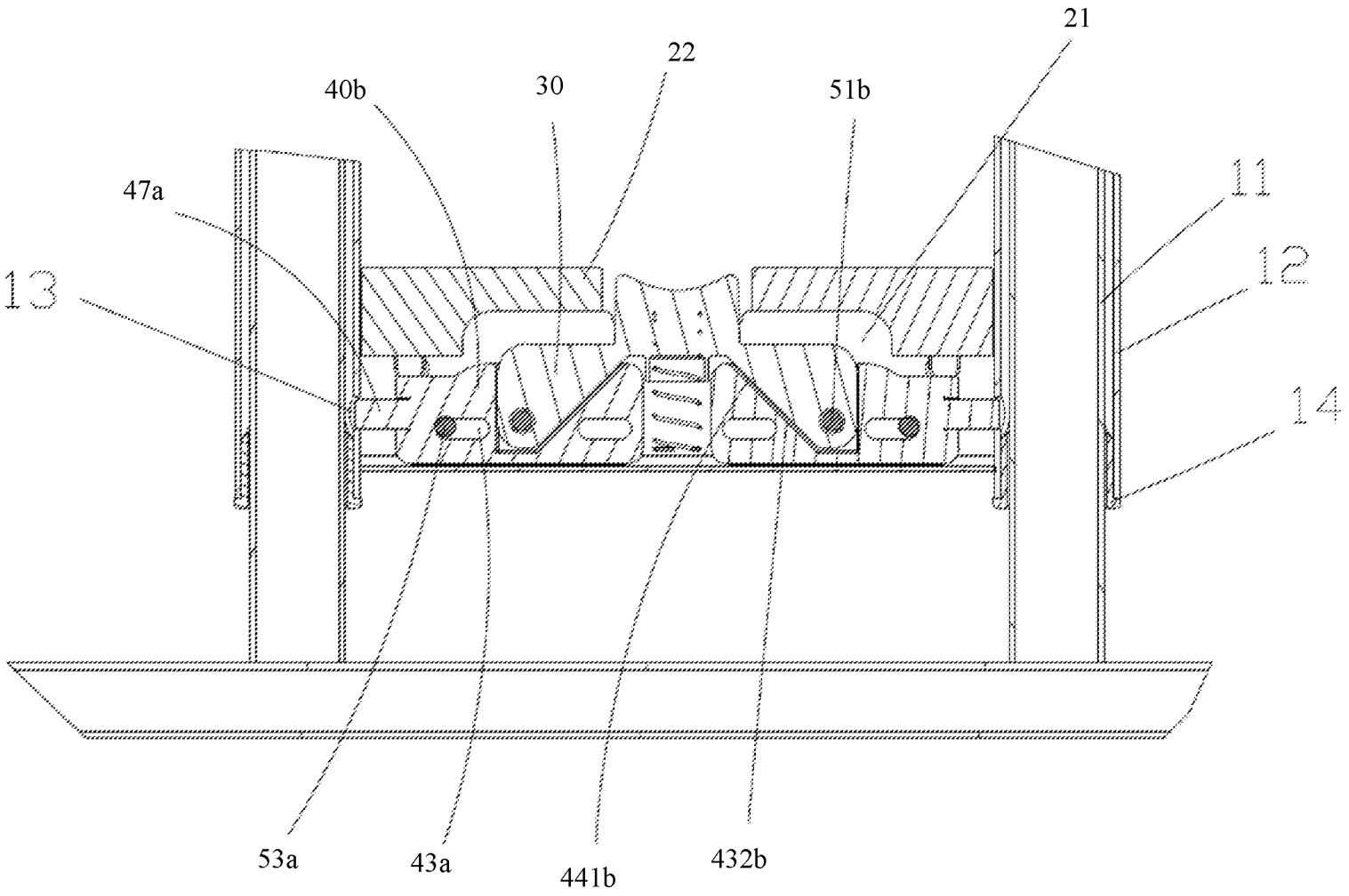
FIG. 16 is a partially enlarged cutout side view illustrating an exemplary adjustment mechanism in an unlocked state in accordance with exemplary embodiments of the present disclosure.

Referring in particular to FIGS. 14 and 16, button 30 is operably coupled with the first and second arms, and is accessible and operable externally, e.g., by a person. The button is movable with respect to the casing along the second direction (e.g., the y-direction in FIG. 14) between a first position and a second position. The first position of the button corresponds to a locking state as illustrated in FIG. 14. As shown, when the button is positioned at the first position, the end of the first or second arm protrudes from the casing and is inserted into the first restriction hole of the outer tubular bar and a restriction member of the inner bar of the respective adjustable support, thereby restricting relative movement of the inner and outer bars in at least one direction. The second position of the button corresponds to an unlocking state as illustrated in FIG. 16. As shown, when the button is positioned at the second position, the end of the first or second arm is disengaged from the inner bar and/or the outer tubular bar, thereby allowing relative movement of the inner and outer bars.

In some exemplary embodiments, to place and keep the button at the first position under normal conditions (e.g., without any external force), the adjustment mechanism includes one or more first elastic members (e.g., string) such as first elastic member 61.

Referring to FIGS. 12A and 14-16, in some exemplary embodiments, the first arm includes a first surface such as surface 432*a* sloped with respect to the first and second directions (e.g., not parallel to either the first or second direction), and the second arm includes a second surface such as surface 432*b* sloped with respect to the first and second directions. In an exemplary embodiment, the first and second surfaces are symmetric with respect to the button. The button includes a third surface such as surface 441*a* and a fourth surface such as surface 441*b* sloped with respect to the first and second directions. The third surface of the button is operably coupled with the first surface of the first arm and the fourth surface of the button is operably coupled with the second surface of the second arm. For instance, in an exemplary embodiment, the third surface of the button is disposed on the first surface of the first arm and the fourth surface of the button is disposed on the second surface of the second arm.

In some exemplary embodiments, similar to adjustment mechanism 210, the first arm of adjustment mechanism 410 includes one or more first slots such as first slot 41*a* and the second arm of adjustment mechanism 410 includes one or more second slots such as second slot 41*b*. Each of the one or more first slots is substantially parallel to the first surface, and each of the one or more second slots is substantially parallel to the second surface. Corresponding to the first and second slots, the button of adjustment mechanism 410 includes one or more first pins such as first pin 51*a* and one or more second pins such as second pin 51*b*. First pin 51*a* is operably coupled with first slot 41*a* and movable along the first slot to guide the movement of the third surface with respect to the first surface of the first arm. Second pin 51*b* is operably coupled with second slot 41*b* and movable along the second slot to guide the movement of the fourth surface with respect to the second surface of the second arm.

In some exemplary embodiments, similar to adjustment mechanism 210, the first arm of adjustment mechanism 410 includes a third slot such as slot 43*a* in the first direction, and casing 20 of adjustment mechanism 410 includes a third pin such as pin 53*a* operably coupled with slot 43*a*. Pin 53*a* is movable along slot 43*a* to guide the movement of the first arm along the first direction. Similarly, second arm 40*b* of adjustment mechanism 410 includes a fourth slot such as fourth slot 43*b* in the first direction, and casing 20 of adjustment mechanism 410 includes a fourth pin such as pin 53*b* operably coupled with the fourth slot. The fourth pin is movable along the fourth slot to guide the movement of the second arm along the first direction.

As the button moves from the first position as illustrated in FIG. 14 to the second position as illustrated in FIG. 16, surface 441*a* of the button, alone or together with pin 51*a* and slot 41*a*, pushes the first arm toward the second arm (away from the first adjustable support) and thus pulls the first end of the first arm out of the restriction member of the inner bar and/or the first restriction hole of the outer tubular bar of the first adjustable support. Similarly, surface 441*b* of the button, alone or together with pin 51*b* and slot 41*b*, pushes the second arm toward the first arm (away from the second adjustable support) and thus pulls the second end of the second arm out of the restriction member of the inner bar and/or the first restriction hole of the outer tubular bar of the second adjustable support. At this state, the inner bar of the respective adjustable support is movable with respect to the outer tubular bar of the respective adjustable support in both directions, e.g., toward or away from the outer tubular bar.

As the button moves upward from the second position to the first position, pins 51*a* and 51*b* move upward as well. Because slots 41*a* and 41*b* are sloped and because the first and second arms are movable in the first direction, the upward movement of the pins pushes the first arm toward the first adjustable support and the second arm toward the second adjustable support. As a result, the first end of the first arm protrudes from the first side of the casing and into the first restriction hole of the outer tubular bar and the restriction member of the inner bar of the first adjustable support, and the second end of the second arm protrudes from the second side of the casing and into the first restriction hole of the outer tubular bar and the restriction member of the inner bar of the second adjustable support. In this state, depending on the configuration of the restriction member of the inner bar, the inner bar is restricted from moving with respect to the outer tubular bar of the respective adjustable support in at least one direction.

It should be noted that all of the components disclosed herein are combinable in any useful number and combination, and some components are exchangeable or alternative to each other. For instance, while FIGS. 1-9 illustrate frame 200 with adjustment mechanism 210, it should be noted that adjustment mechanism 410 can be readily used in frame 200 or the like. Similarly, while FIGS. 10-16 illustrate frame 310 with adjustment mechanism 410, it should be noted that adjustment mechanism 210 can be readily used in frame 310 or the like.

Figure 15:
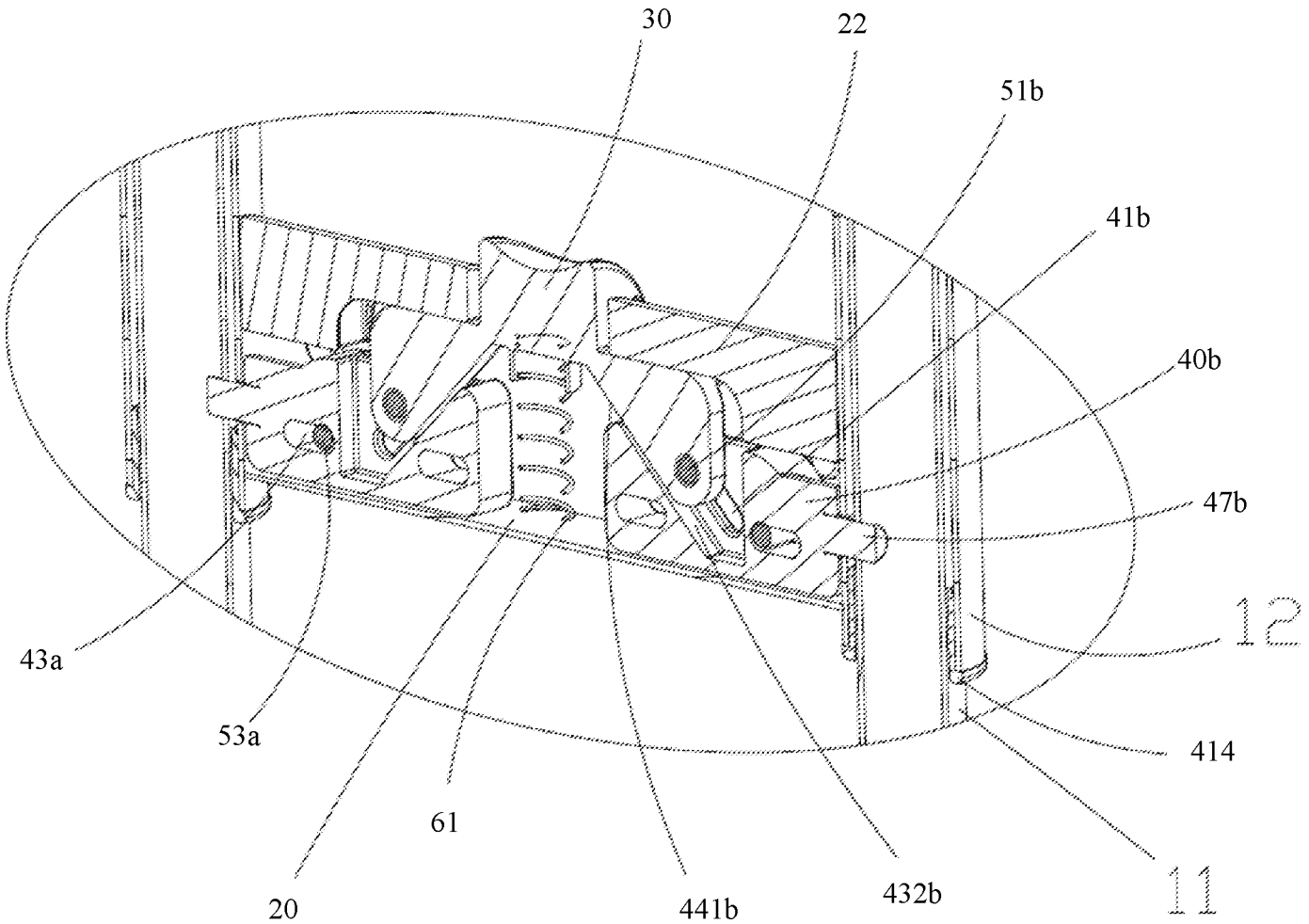
FIG. 15 is a partially enlarged cutout perspective view illustrating an exemplary adjustment mechanism in a locked state in accordance with exemplary embodiments of the present disclosure.

It should also be noted that the adjustment mechanisms, adjustable assemblies, frames and tables of the present disclosure can include other optional, alternative, or additional components. For instance, FIG. 15 illustrates the proximal end (e.g., the lower end in FIG. 15) of outer tubular bar 12 coupled with rubber sleeve 414 to help stabilizing and smoothing the relative movement of the inner bar into or out of the outer tubular bar.

With the adjustment mechanisms of the present disclosure, it is easy and convenient to adjust the height of the frames and thus the table panels. For instance, referring back to FIGS. 1 and 10, due to at least in part the configurations of the one-way restriction structure(s) of the inner bar, the adjustable assembly can expand (e.g., increase the length of the first and second adjustable supports) without any additional restrictions. In other words, the height of side bar 70*a* and side bar 70*d* (and thus parts such as a tabletop coupled with the side bars) or table panel 390 can be increased by simply lifting the side bars (or tabletop) or the table panel. To reduce the height, one needs only to press the button, which will unlock the first and second adjustable bars and allow the inner bar to retract into the outer bar. As such, the frames and tables of the present disclosure are very convenient to use. Moreover, due to at least in part the bias member(s) such as elastic member 61, elastic member 62*a* and/or elastic member 62*b*, the adjustment mechanism automatically locks the first and second adjustable supports under normal conditions (e.g., in the absence of an external force). This prevents accidental decreasing of the height of the adjustable assembly and/or collapsing the frame or table. As such, the frames and tables of the present disclosure of the present disclosure are safer to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. An adjustment mechanism comprising:

a casing comprising a first side, a second side and a channel between the first and second sides;

a first arm disposed in the channel of the casing and movable with respect to the casing along a first direction, the first arm comprising a first end adjacent to the first side of the casing;

a second arm disposed in the channel of the casing and movable with respect to the casing along the first direction, the second arm comprising a second end adjacent to the second side of the casing;

a button coupled with the first and second arms and movable with respect to the casing along a second direction that is substantially perpendicular to the first direction, wherein:

one or more first slots are formed at one of the first arm and the button, each first slot including two sides that are substantially parallel to each other and sloped with respect to the first direction and the second direction;

one or more first pins are formed at the other of the first arm and the button, wherein each respective first pin in the one or more first pins is oriented substantially perpendicularly to the first and second directions such that, cross-sectional-wise, each respective first pin in the one or more first pins is disposed in a corresponding first slot in the one or more first slots and movable along the corresponding first slot, wherein the one or more first pins and the one or more first slots collectively transfer the movement of the button along the second direction to the movement of the first arm along the first direction, thereby selectively pushing the first end of the first arm out of the first side of the casing;

one or more second slots are formed at one of the second arm and the button, each second slots including two sides that are substantially parallel to each other and sloped with respect to the first direction and the second direction; and one or more second pins are formed at the other of the second arm and the button, each respective second pin in the one or more second pins is oriented substantially perpendicularly to the first and second directions such that, cross-sectional-wise, each respective second pin in the one or more second pins is disposed in a corresponding second slot in the one or more second slots and movable along the corresponding second slot, wherein the one or more second pins and the one or more second slots collectively transfer the movement of the button along the second direction to the movement of the second arm along the first direction, thereby selectively pushing the second end of the second arm out of the second side of the casing; and at least two first elastic members aligned substantially in the second direction, each comprising a first end abutting the casing and a second end abutting the button, thereby holding the button at a fixed position in the absence of any external force such that the first end of the first arm remains outside of the first side of the casing and the second end of the second arm remains outside of the second side of the casing, wherein one of the at least two first elastic members is disposed adjacent to the first arm and another of the at least two first elastic members is disposed adjacent to the second arm.

2. The adjustment mechanism of claim 1, wherein the button comprises at least two cavities, each for accommodating at least a portion of a first elastic member in the at least two first elastic members.

3. The adjustment mechanism of claim 1, wherein:

the button comprises one or more fifth slots in the second direction; and the casing comprises one or more fifth pins, each respective fifth pin in the one or more fifth pins is operably coupled with a corresponding fifth slot in the one or more fifth slots and movable along the corresponding second slot to guide the movement of the button in the second direction.

4. The adjustment mechanism of claim 1, wherein:

the first arm comprises a first surface sloped with respect to the first and second directions;

the second arm comprises a second surface sloped with respect to the first and second directions; and the button comprises a third surface and a fourth surface sloped with respect to the first and second directions, wherein the third surface is operably coupled with the first surface of the first arm, thereby transferring the movement of the button along the second direction to the movement of the first arm along the first direction, and the fourth surface is operably coupled with the second surface of the second arm, thereby the movement of the button along the second direction to the movement of the second arm along the first direction.

5. An adjustment mechanism comprising:

a casing comprising a first side, a second side and a channel between the first and second sides;

a first arm disposed in the channel of the casing and comprising a first end adjacent to the first side of the casing, wherein the first arm is movable with respect to the casing along a first direction to selectively allow the first end of the first arm to protrude from the first side of the casing;

a second arm disposed in the channel of the casing and comprising a second end adjacent to the second side of the casing, wherein the second arm is movable with respect to the casing along the first direction to selectively allow the second end of the second arm to protrude from the second side of the casing;

a button operably coupled with the first and second arms and movable with respect to the casing along a second direction substantially perpendicular to the first direction, wherein movement of the button along the second direction causes movement of the first and second arms along the first direction; and one or more first elastic members, each comprising a first end abutting the casing and a second end abutting the button, thereby holding the button at a fixed position in the absence of any external force such that the first end of the first arm remains outside of the first side of the casing and the second end of the second arm remains outside of the second side of the casing;

wherein:

the first arm comprises a first surface sloped with respect to the first and second directions;

the second arm comprises a second surface sloped with respect to the first and second directions;

the button comprises a third surface and a fourth surface sloped with respect to the first and second directions, wherein the third surface is operably coupled with the first surface of the first arm, thereby transferring the movement of the button along the second direction to the movement of the first arm along the first direction, and the fourth surface is operably coupled with the second surface of the second arm, thereby the movement of the button along the second direction to the movement of the second arm along the first direction;

the first arm comprises one or more first slots each substantially parallel to the first surface;

the second arm comprises one or more second slots each substantially parallel to the second surface; and the button comprises one or more first pins and one or more second pins, wherein each respective first pin in the one or more first pins is operably coupled with a corresponding first slot in the one or more first slots and movable along the corresponding first slot to guide the movement of the third surface with respect to the first surface of the first arm;

each respective second pin in the one or more second pins is operably coupled with a corresponding second slot in the one or more second slots and movable along the corresponding second slot to guide the movement of the fourth surface with respect to the second surface of the second arm.

6. The adjustment mechanism of claim 5, wherein:

the first arm comprises one or more first slots sloped with respect to the first and second directions;

the second arm comprises one or more second slots sloped with respect to the first and second directions; and the button comprises one or more first pins and one or more second pins, wherein each respective first pin in the one or more first pins is operably coupled with a corresponding first slot in the one or more first slots and movable along the corresponding first slot, each respective second pin in the one or more second pins is operably coupled with a corresponding second slot in the one or more second slots and movable along the corresponding second slot, the one or more first pins and the one or more first slots collectively transfer the movement of the button along the second direction to the movement of the first arm along the first direction, and the one or more second pins and the one or more second slots collectively transfer the movement of the button along the second direction to the movement of the second arm along the first direction.

7. The adjustment mechanism of claim 5, wherein:

the first arm comprises a third slot in the first direction;

the second arm comprises a fourth slot in the first direction; and the casing comprises a third pin and a fourth pin, wherein the third pin is operably coupled with the third slot and movable along the third slot to guide the movement of the first arm along the first direction, and the fourth pin is operably coupled with the fourth slot and movable along the fourth slot to guide the movement of the second arm along the first direction.

8. The adjustment mechanism of claim 7, further comprising:

a second elastic member disposed at the third slot of the first arm, the second elastic member having a first end abutting the third pin and a second end abutting an end of the third slot that faces the first end of the first arm, thereby maintaining the first end of the first arm out of the first side of the casing in the absence of an external force; and a third elastic member disposed at the fourth slot of the second arm, the third elastic member having a first end abutting the fourth pin and a second end abutting an end of the fourth slot that faces the second end of the second arm, thereby maintaining the second end of the second arm out of the second side of the casing in the absence of an external force.

9. The adjustment mechanism of claim 8, wherein:

the first arm includes a first protection piece coupled or integrally formed with the third slot of the first arm to prevent disengagement of the second elastic member from the third slot of the first arm; and the second arm includes a second protection piece coupled or integrally formed with the fourth slot of the second arm to prevent disengagement of the third elastic member from the fourth slot of the second arm.

10. An adjustment mechanism comprising:

a casing comprising a first side, a second side and a channel between the first and second sides;

a first arm disposed in the channel of the casing and movable with respect to the casing along a first direction, the first arm comprising:

a first end adjacent to the first side of the casing, and one or more first slots, each including two sides that are substantially parallel to each other and sloped with respect to the first direction and a second direction substantially perpendicular to the first direction;

a second arm disposed in the channel of the casing and movable with respect to the casing along the first direction, the second arm comprising:

a second end adjacent to the second side of the casing, and one or more second slots, each including two sides that are substantially parallel to each other and sloped with respect to the first direction and the second direction; and a button coupled with the first and second arms and movable with respect to the casing along the second direction, the button comprising one or more first pins and one or more second pins, wherein each respective first pin in the one or more first pins is oriented substantially perpendicularly to the first and second directions such that, cross-sectional-wise, each respective first pin in the one or more first pins is disposed in a corresponding first slot in the one or more first slots and movable along the corresponding first slot, each respective second pin in the one or more second pins is oriented substantially perpendicularly to the first and second directions such that, cross-sectional-wise, each respective second pin in the one or more second pins is disposed in a corresponding second slot in the one or more second slots and movable along the corresponding second slot, the one or more first pins and the one or more first slots collectively transfer the movement of the button along the second direction to the movement of the first arm along the first direction, thereby selectively pushing the first end of the first arm out of the first side of the casing, and the one or more second pins and the one or more second slots collectively transfer the movement of the button along the second direction to the movement of the second arm along the first direction, thereby selectively pushing the second end of the second arm out of the second side of the casing.

11. The adjustment mechanism of claim 10, wherein the first and second arms are substantially symmetric with respect to the button.

12. The adjustment mechanism of claim 10, the casing comprises a cover, and the button is accessible from an exterior side of the cover.

13. The adjustment mechanism of claim 10, wherein each of the first and second arms is substantially straight and elongated along the first direction with a curved or sloped surface, and each of the first end of the first arm and the second end of the second arm comprises a curved or sloped surface.

14. The adjustment mechanism of claim 10, wherein:

the first arm comprises a third slot in the first direction;

the second arm comprises a fourth slot in the first direction; and the casing comprises a third pin and a fourth pin, wherein the third pin is operably coupled with the third slot and movable along the third slot to guide the movement of the first arm along the first direction, and the fourth pin is operably coupled with the fourth slot and movable along the fourth slot to guide the movement of the second arm along the first direction.

15. The adjustment mechanism of claim 14, further comprising:

a second elastic member disposed at the third slot of the first arm, the second elastic member having a first end abutting the third pin and a second end abutting an end of the third slot that faces the first end of the first arm, thereby maintaining the first end of the first arm out of the first side of the casing in the absence of an external force; and a third elastic member disposed at the fourth slot of the second arm, the third elastic member having a first end abutting the fourth pin and a second end abutting an end of the fourth slot that faces the second end of the second arm, thereby maintaining the second end of the second arm out of the second side of the casing in the absence of an external force.

16. The adjustment mechanism of claim 15, wherein:

the first arm includes a first protection piece coupled or integrally formed with the third slot of the first arm to prevent disengagement of the second elastic member from the third slot of the first arm; and the second arm includes a second protection piece coupled or integrally formed with the fourth slot of the second arm to prevent disengagement of the third elastic member from the fourth slot of the second arm.

17. An adjustable assembly comprising:

a first adjustable support and a second adjustable support disposed substantially parallel to the first adjustable support, wherein each of the first and second adjustable supports comprises:

an outer tubular bar comprising a first restriction hole formed on a first wall of the outer tubular bar; and an inner bar telescopically coupled with the outer tubular bar and comprising a plurality of restriction members formed at a first wall of the inner; and the adjustment mechanism of claim 10, disposed in between the first and second adjustable supports, wherein the first side of the adjustment mechanism is coupled with the first adjustable support such that the first end of the first arm is selectively protruded out of the first side of the casing and selectively inserted into the first restriction hole of the outer tubular bar and any one respective restriction member in the plurality of restriction members of the inner bar of the first adjustable support, thereby selectively restricting movement of the inner bar with respect to the outer tubular bar of the first adjustable support, and the second side of the adjustment mechanism is coupled with the second adjustable support such that the second end of the second arm is selectively protruded out of the second side of the casing and selectively inserted into the first restriction hole of the outer tubular bar and any one respective restriction member in the plurality of restriction members of the inner bar of the second adjustable support, thereby selectively restricting movement of the inner bar with respect to the outer tubular bar of the second adjustable support.

18. An adjustable assembly comprising:

a first adjustable support and a second adjustable support spaced apart and substantially parallel to the first adjustable support, wherein each of the first and second adjustable supports comprises:

an outer tubular bar comprising a first restriction hole formed on a first wall of the outer tubular bar; and an inner bar telescopically coupled with the outer tubular bar and comprising a plurality of restriction members formed at a first wall of the inner; and the adjustment mechanism of claim 1 disposed in between the first and second adjustable supports, wherein the first side of the adjustment mechanism is coupled with the first adjustable support such that the first end of the first arm is selectively protruded out of the first side of the casing and selectively inserted into the first restriction hole of the outer tubular bar and any one respective restriction member in the plurality of restriction members of the inner bar of the first adjustable support, thereby selectively restricting movement of the inner bar with respect to the outer tubular bar of the first adjustable support, and the second side of the adjustment mechanism is coupled with the second adjustable support such that the second end of the second arm is selectively protruded out of the second side of the casing and selectively inserted into the first restriction hole of the outer tubular bar and any one respective restriction member in the plurality of restriction members of the inner bar of the second adjustable support, thereby selectively restricting movement of the inner bar with respect to the outer tubular bar of the second adjustable support.

19. The adjustable assembly of claim 18, wherein:

of each of the first and second adjustable supports, the plurality of restriction members of the inner bar comprises one or more one-way restriction structures, each respective one-way restriction structure in the one or more one-way restriction structures comprising:

a restriction slot formed at the first wall of the inner bar and comprising a proximal edge toward the proximal end of the inner bar and a distal edge toward the distal end of the inner bar; and a restriction tongue integrally formed or connected with one of the proximal and distal edges of the restriction slot and curved inwardly with respect to the first wall of the inner bar along the length direction of the inner bar toward the other of the proximal and distal edges of the restriction slot, thereby allowing the adjustment mechanism to restrict the inner bar from moving with respect to the outer tubular bar in one direction but not the other.

20. The adjustable assembly of claim 19, wherein each of the first end of the first arm and the second end of the second arm comprises a curved or sloped surface operably coupled with the restriction tongue of the respective one-way restriction structure of the inner bar to aid disengagement of the first end of the first arm and the second end of the second arm from the restriction slot at the one of the proximal and distal edges of the restriction slot.

* * * * *